US008606133B2

(12) United States Patent
Higa

(10) Patent No.: US 8,606,133 B2
(45) Date of Patent: Dec. 10, 2013

(54) IMAGE FORMING APPARATUS

(75) Inventor: Takuma Higa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 334 days.

(21) Appl. No.: 13/045,017

(22) Filed: Mar. 10, 2011

(65) Prior Publication Data

US 2011/0229820 A1 Sep. 22, 2011

(30) Foreign Application Priority Data

Mar. 18, 2010 (JP) ..... 2010-063361

(51) Int. Cl.
*G03G 15/16* (2006.01)

(52) U.S. Cl.
USPC ..... 399/66; 399/49; 399/302; 399/314

(58) Field of Classification Search
USPC ..... 399/49, 66, 302, 314
See application file for complete search history.

(56) References Cited

U.S. PATENT DOCUMENTS

| | | | | |
|---|---|---|---|---|
| 2008/0025738 | A1 * | 1/2008 | Ahn et al. | 399/27 |
| 2010/0080576 | A1 | 4/2010 | Nakayama et al. | |
| 2011/0110676 | A1 | 5/2011 | Higa | |

FOREIGN PATENT DOCUMENTS

| | | | |
|---|---|---|---|
| JP | 3554653 | | 5/2004 |
| JP | 3922301 | | 3/2007 |
| JP | 2007-101980 | | 4/2007 |
| JP | 2008-102356 | * | 5/2008 |
| JP | 2009-230003 | * | 10/2009 |

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A toner pattern for detecting the degree of toner deterioration is created on a photosensitive element and transferred to an intermediate transfer belt by a primary transfer unit under a transfer condition different from that at the time of image formation. A toner adhesion amount detection unit detects the toner adhesion amount of the toner pattern at multiple places. A degree-of-toner-deterioration calculation unit calculates the degree of toner deterioration on the basis of the variation in data of the toner adhesion amount at multiple places detected by the toner adhesion amount detection unit. A background potential determination coefficient in a process control unit is controlled on the basis of the degree of toner deterioration calculated by the degree-of-toner-deterioration calculation unit.

9 Claims, 15 Drawing Sheets

IMAGE FORMING APPARATUS

CROSS-REFERENCE TO RELATED APPLICATIONS

The present application claims priority to and incorporates by reference the entire contents of Japanese Patent Application No. 2010-063361 filed in Japan on Mar. 18, 2010.

BACKGROUND OF THE INVENTION

1. Field of the Invention

The present invention relates to an image forming apparatus, such as a printer, a facsimile, or a copying machine.

2. Description of the Related Art

In an image forming apparatus, there is a demand for stably obtaining high-quality images for a long period of time, but time-dependent deterioration in toner may cause changes in image quality. For example, in an image forming apparatus which uses two-component developer containing toner and carriers to form toner images, toner deterioration occurs due to repetitive stress caused by a developer regulating member or the like which is provided to optimize the amount of developer on the developer carrier, causing changes in the charged toner amount. Thus, desired image density may not be obtained, or background fouling, interior contamination due to toner scattering or the like may occur.

Similarly to two-component developer, in one-component developer, toner deterioration occurs due to repetitive stress caused by a developing roller, a developer regulating member, and the like, and additives attached to the surfaces of toner particles are buried in the toner particles or separated from the toner particles. The occurrence of such an event causes a significant difference in toner charge amount between deteriorated toner and newly replenished toner, resulting in background fouling or erraticness.

In an intermediate transfer type image forming apparatus, deterioration of developer makes the charge amount unstable, resulting in unstable transfer of a toner image from an image carrier to an intermediate transfer element. For this reason, primary transfer efficiency is degraded, and deterioration of an image transferred onto a transfer material, such as paper, tends to be noticeable.

As described above, if toner deterioration occurs and developer is deteriorated, image quality of an image transferred onto a transfer material, such as paper, is degraded. The major factor of the above-described phenomenon is deterioration of toner in developer. Thus, deteriorated toner is discharged, and new toner is put in developer and stirred, thereby obtaining a good-quality image on a transfer material, such as paper.

In the relate art, a technique is known in which, when it is considered that the ratio of deteriorated toner increases, toner in developer is replaced so as to obtain high-quality images over a long period of time. For example, Japanese Patent Application Laid-open No. 2006-171788 describes an apparatus in which, when an image area is small and toner consumption is low, toner is forcibly consumed in a region other than an image region. When toner consumption is low, toner undergoes repetitive stress and toner deterioration is noticeable. Thus, toner is forcibly consumed in a region other than an image region, toner in developer is replaced, and then, development is carried out. However, according to this method, wasteful toner consumption occurs, leading to an increase in cost. Further, in this method, instead of detecting the degree of toner deterioration and replacing a necessary amount of toner, if it is anticipated that toner consumption is low, toner is replaced. For this reason, it is unclear how much it is possible to cope with actual toner deterioration. As described above, the technique of the related art in which deteriorated toner in developer is replaced has various problems. Thus, there is a demand for obtaining high-quality images even when deteriorated toner is contained in developer.

A technique is known in which an actual toner adhesion amount is measured, and process control is performed so as to obtain high-quality images over a long period of time. For example, Japanese Patent Application Laid-open No. 2007-101980 describes a technique in which a toner pattern formed on a photosensitive element is transferred to an intermediate transfer element, and the toner adhesion amount of the toner pattern on the intermediate transfer element is detected and fed back to the toner image forming conditions, such as the charging condition and the developing condition, on the photosensitive element. According to this technique, an actual toner adhesion amount is measured and the toner image forming conditions are determined, making it easy to obtain an appropriate toner adhesion amount.

However, even when an appropriate toner adhesion amount on an image carrier is obtained by the above-described process control, if toner which is deteriorated with time is included in a toner image formed on the image carrier, deteriorated toner tends not to be easily transferred, and the toner adhesion amount of the toner image formed on the recording medium is not uniform, leading to degradation in image quality.

As the index of image quality, smoothness of gradation is exemplified. The gradation is a change in color density, that is, the steps of color. For example, in the case of white and black, there is gray as an intermediate color, and gray includes light gray and dark gray. If many steps are set, in the case of two colors of white and black, a picturesque image with smooth color changes can be formed. From among the gradations, the brightest gradation portion is called highlight, an intermediate gradation portion is called halftone, and the darkest gradation portion is called shadow. Of these, the halftone portion is largely affected by deteriorated toner. With the effect of deteriorated toner, degradation in image density is noticeable in the halftone portion, causing degradation smoothness of gradation. FIG. 15 shows a relationship between an input image area ratio and image density for new developer and deteriorated developer. As shown in FIG. 15, when deteriorated developer containing deteriorated toner is used, image density in the halftone is degraded compared to new developer, and a change in image density is not uniform, making it difficult to obtain appropriate density gradation.

SUMMARY OF THE INVENTION

It is an object of the present invention to at least partially solve the problems in the conventional technology.

According to an aspect of the present invention, there is provided an image forming apparatus that includes an image carrier; a toner image forming unit that forms a toner image on the image carrier; a primary transfer unit that transfers the toner image on the image carrier to an intermediate transfer element; a secondary transfer unit that transfers the toner image on the intermediate transfer element to a recording medium; a toner adhesion amount detection unit that detects a toner adhesion amount of the toner image transferred to the intermediate transfer element; a process control unit that causes the toner image forming unit to form a predetermined toner pattern by a normal image forming operation on a surface of the image carrier at a predetermined timing, causes the primary transfer unit to transfer the predetermined toner pattern on the intermediate transfer element, causes the toner adhesion amount detection unit to detect a toner adhesion amount of the predetermined toner pattern, and adjusts at least one of a charging bias, an exposure amount, and a developing bias on the basis of the detection result so as to obtain a developing potential, which is a difference between a developing bias and a potential of an electrostatic latent image portion, so that a toner adhesion amount of a predetermined electrostatic latent image reaches a target toner adhesion amount; and a degree-of-toner-deterioration calculation unit that calculates a degree of toner deterioration from the toner adhesion amount detected by the toner adhesion amount detection unit. The process control unit further causes the toner image forming unit to form a toner pattern for detecting a degree of toner deterioration on the image carrier, causes the primary transfer unit to transfer the toner pattern from the image carrier to the intermediate transfer element under a transfer condition such that transfer efficiency is lowered compared to a transfer condition at the time of image formation, causes the toner adhesion amount detection unit to detect toner adhesion amount of the toner pattern at multiple places, causes the degree-of toner-deterioration calculation unit to calculate a degree of toner deterioration on the basis of a variation in data of the toner adhesion amount at the multiple places detected by the toner adhesion amount detection unit, and controls a ratio of the difference between a potential of a non-electrostatic latent image portion and the developing bias to the developing potential depending on the degree of toner deterioration calculated by the degree-of-toner-deterioration calculation unit.

According to another aspect of the present invention, there is provided an image forming method performed in an image forming apparatus that includes an image carrier, a toner image forming unit, a primary transfer unit, a secondary transfer unit, a toner adhesion amount detection unit, a process control unit, and a degree-of-toner-deterioration calculation unit. The method, which is performed using the process control unit, includes causing the toner image forming unit to form a toner pattern for detecting a degree of toner deterioration on the image carrier; causing the primary transfer unit to transfer the toner pattern from the image carrier to the intermediate transfer element under a transfer condition such that transfer efficiency is lowered compared to a transfer condition at the time of normal image formation; causing the toner adhesion amount detection unit to detect toner adhesion amount of the toner pattern at multiple places; causing the degree-of toner-deterioration calculation unit to calculate a degree of toner deterioration on the basis of a variation in data of the toner adhesion amount at the multiple places detected by the toner adhesion amount detection unit, and controlling a ratio of the difference between a potential of a non-electrostatic latent image portion and a developing bias to a developing potential depending on the degree of toner deterioration calculated by the degree-of-toner-deterioration calculation unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of an electrophotographic printer as an image forming apparatus to which the invention is applied will be described. First, the overall configuration and operation of the printer will be described.

Overall Configuration and Operation of Apparatus

Figure 1:
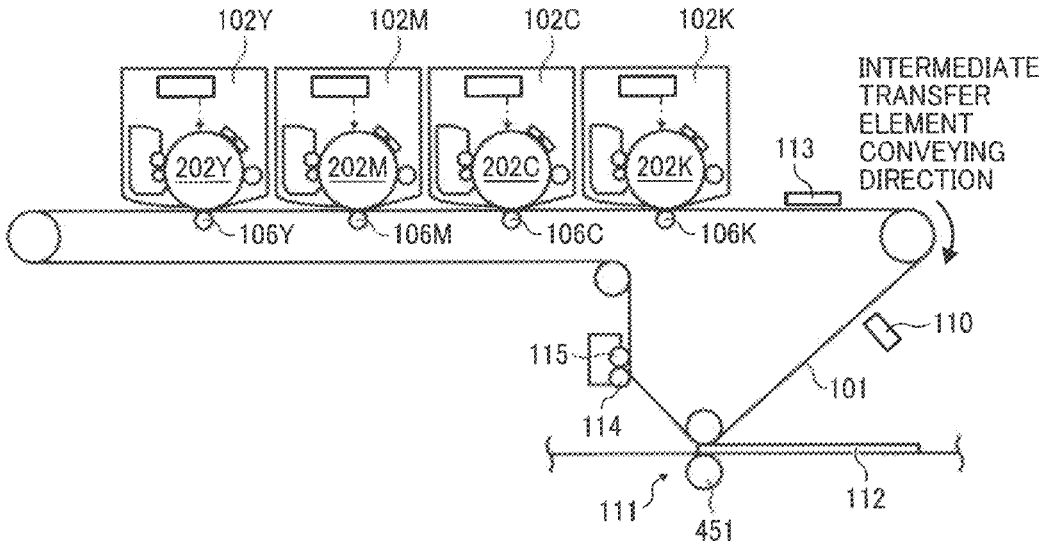
FIG. 1 is an explanatory view showing the schematic configuration of a main part of a printer according to an embodiment.

FIG. 1 is a schematic configuration diagram showing a main part of the printer of this embodiment. The printer includes image forming units 102Y, 102M, 102C, and 102K as a colored toner image forming unit which respectively form four colored toner images of yellow (Y), magenta (M), cyan (C), and black (K). The image forming units 102Y, 102M, 102C, and 102K are arranged in parallel along an intermediate transfer belt 101 undergoes surface movement in a state of being stretched between a plurality of stretching rollers. That is, the printer is a tandem type printer. At the positions in the inner circumferential portion of the intermediate transfer belt 101 facing the respective image forming units, primary transfer units 106Y, 106M, 106C, and 106K are provided to respectively transfer the Y, M, C, and K colored toner images formed by the respective image forming units to the intermediate transfer belt 101. In the downstream portion below the primary transfer units 106Y, 106M, 106C, and 106K with respect to the surface movement direction of the intermediate transfer belt 101, an image detection unit 110 serving as a toner adhesion amount detection unit is provided to detect the toner adhesion amount of each toner image transferred to the intermediate transfer belt 101 so as to face the intermediate transfer belt 101. In the downstream portion below the image detection unit 110, a secondary transfer unit 111 is provided to transfer the toner images on the intermediate transfer belt 101 to a recording medium 112. In the downstream portion, an intermediate transfer belt cleaner 114 serving as a cleaning unit is also provided to clean residual transfer toner on the intermediate transfer belt 101.

Next, the image forming units 102Y, 102M, 102C, and 102K will be described. The image forming units 102Y, 102M, 102C, and 102K have the same configuration, except that the colors of toner to be accommodated therein are different. Hereinafter, the symbol corresponding to each color will be omitted, and description will be provided without distinction.

Figure 2:
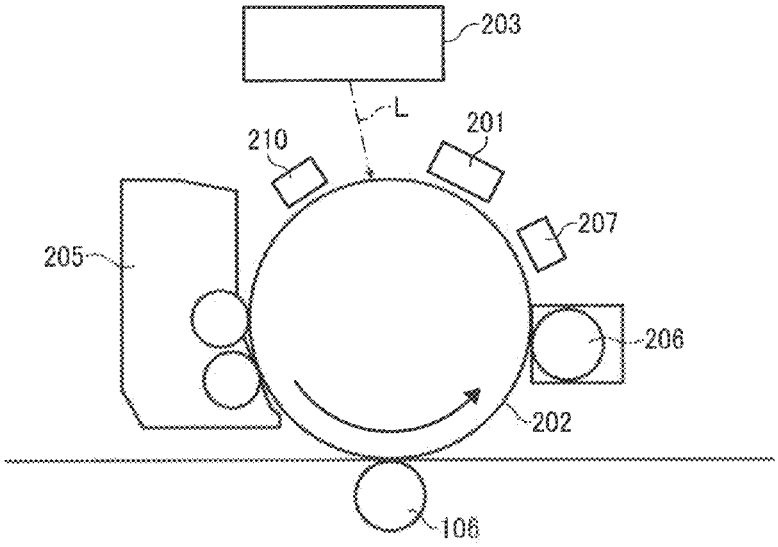
FIG. 2 is an explanatory view showing the schematic configuration of an image forming unit of the printer.

FIG. 2 is a schematic configuration diagram of an image forming unit 102. The image forming unit 102 includes a photosensitive element 202 serving as an image carrier. Around the photosensitive element 202 are provided a charging device 201 serving as a charging unit which charges the surface of the photosensitive element 202, a writing device 203 serving as an exposure unit which writes an electrostatic latent image on the surface of the photosensitive element by write light L, a developing device 205 serving as a developing unit which develops the electrostatic latent image with toner, a photosensitive element cleaner 206 serving as a cleaning unit which cleans residual transfer toner on the photosensitive element 202, an eraser (neutralization device) 207 which neutralizes the surface of the photosensitive element, and a potential sensor 210 serving as a potential detection unit.

The charging device 201 of this embodiment is a non-contact charger constituted by a scorotron charger, and sets a grid voltage (charging bias) Vg of the scorotron charger to a target charging potential (in this embodiment, negative potential), such that the potential of the surface of the photosensitive element is set to the target charging potential. Here, the charging device 201 is not limited to the scorotron charger, and other non-contact chargers or contact chargers may be used.

The writing device 203 of this embodiment uses a laser diode (LD) as a light source, and irradiates intermittent write light, that is, write light L in the form of repetitive pulses to form an electrostatic latent image (hereinafter, referred to as one-dot electrostatic latent image) for each dot on the surface of the photosensitive element. In this embodiment, an exposure time (unit exposure time) in forming a one-dot electrostatic latent image is changed to control the toner adhesion amount adhering to the one-dot electrostatic latent image. Thus, gradation control can be performed. In this embodiment, the maximum unit exposure time is divided into 15 pieces (hereinafter, each unit exposure time is referred to as "exposure duty"), such that gradation control of 16 gradations can be performed. Thus, in this embodiment, adjustment can be done in 16 stages of the exposure duty in the range of 0 (no exposure) to 15 (maximum unit exposure time).

The developing device 205 of this embodiment includes a developing roller serving as a developer carrier which is arranged to face the surface of the photosensitive element 202, and carries two-component developer containing toner charged with a predetermined polarity (in this embodiment, negative polarity) and magnetic carriers on the developing roller to supply toner to the surface of the photosensitive element 202. To the developing roller, a developing bias Vb whose absolute value is sufficiently higher than an exposed portion potential VL and sufficiently lower than a charging potential Vd is applied. Thus, in a developing region where the surface of the photosensitive element 202 and the developing roller face each other, an electric field is formed such that toner is moved toward an electrostatic latent image (exposed portion) on the surface of the photosensitive element 202, and toner is not moved toward a non-electrostatic latent image (unexposed portion) on the surface of the photosensitive element 202. The electric field allows the electrostatic latent image to be developed with toner.

In forming a toner image by the image forming unit 102 configured as above, first, the charging device 201 charges the surface of the photosensitive element such that the surface of the photosensitive element 202 is uniformly charged with a target charging potential (negative potential). Next, write light L corresponding to image data is exposed from the light source (LD) of the writing device 203 to the photosensitive element 202 for the charged surface of the photosensitive element. When this happens, the potential (absolute value) of the exposed portion on the surface of the photosensitive element falls, and an electrostatic latent image is formed on the surface of the photosensitive element. Thereafter, the electrostatic latent image (in this embodiment, exposed portion) formed on the photosensitive element 202 is developed to a toner image with toner carried on the developing roller serving as a developer carrier of the developing device 205. Specifically, the developing bias Vb whose absolute value is higher than the exposed portion potential VL and lower than the charging potential Vd is applied to the developing roller, and toner which is charged with a predetermined polarity (in this embodiment, negative polarity) adheres to the electrostatic latent image. In this way, development is carried out.

The toner image formed on the photosensitive element 202 is transferred to the intermediate transfer belt 101 by a primary transfer unit 106. Residual transfer toner which has not been transferred to the intermediate transfer belt 101 and remains on the photosensitive element 202 is collected by the photosensitive element cleaner 206. The eraser 207 uniformly irradiates neutralization light onto the surface of the photosensitive element after the toner image has been transferred to the intermediate transfer belt 101. Thus, the non-electrostatic latent image portion is removed and the surface of the photosensitive element is uniformly neutralized.

In this way, the toner images formed on photosensitive elements 202Y, 202M, 202C, and 202K by the image forming units 102Y, 102M, 102C, and 102K are transferred to the intermediate transfer belt 101 by the primary transfer units 106Y, 106M, 106C, and 106K, respectively.

The secondary transfer unit 111 has a secondary transfer roller 451 which comes into contact with the intermediate transfer belt 101 with the recording medium 112 serving as a recording medium sandwiched therebetween. A voltage is applied from a power source (not shown) to the secondary transfer roller 451, and a predetermined transfer current flows between the secondary transfer roller 451 and the intermediate transfer belt 101. The secondary transfer unit 111 transfers the toner image on the intermediate transfer belt 101 to the recording medium 112 by a transfer nip pressure by the secondary transfer roller 451 and the transfer current. At this time, residual transfer toner which has not been transferred to the recording medium 112 and remains on the intermediate transfer belt 101 is collected by the intermediate transfer belt cleaner 114. Thereafter, the toner image is fixed to the recording medium 112 by a fixing device (not shown), and a sequence of processes ends.

Process Control

Next, process control will be described in which, in order to stabilize an output image, the toner adhesion amount that adheres to a prescribed one-dot electrostatic latent image is stabilized. For simplification of description, description will be provided focusing on control to adjust the charging bias Vg, the developing bias Vb, and exposure power (hereinafter, referred to as "LD power"). Although in this embodiment, the process control includes exposure amount adjustment control to adjust a reference exposure amount at the time of image formation by the writing device 203, the exposure amount adjustment control may be provided separately the process control.

Figure 3:
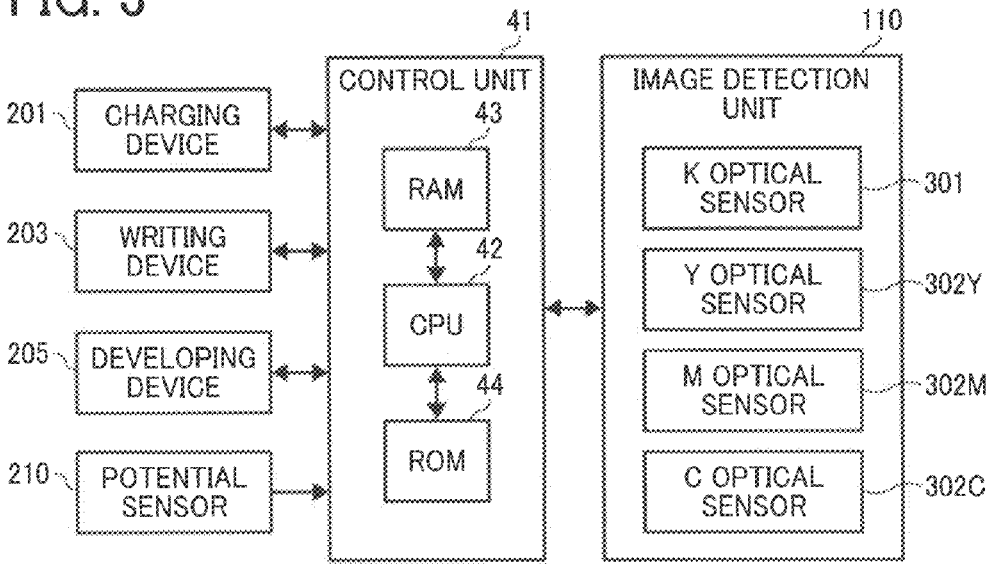
FIG. 3 is a block diagram showing a control system relating to process control in the embodiment.

FIG. 3 is a block diagram showing a control system relating to process control in this embodiment. In the process control of this embodiment, first, a density patch 113 as a toner pattern (toner image) is formed on the intermediate transfer belt 101 by a normal image forming operation under a predetermined condition, and the toner adhesion amount of the density patch 113 is detected by the image detection unit 110 constituted by the optical sensors 301 and 302 described below serving as an optical reflected density sensor. A control unit 41 adjusts the grid voltage (charging bias) Vg, the charging device 201, the developing bias Vb of the developing device 205, and the LD power of the writing device 203 on the basis of the detection result of the image detection unit 110.

Figure 4A:
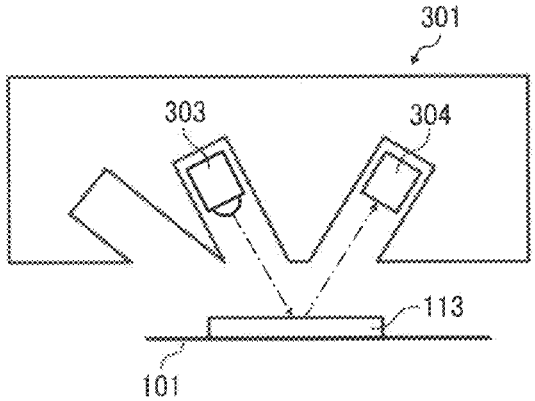
FIG. 4A is an explanatory view showing the schematic configuration of an optical sensor constituting a black image detection device.
Figure 4B:
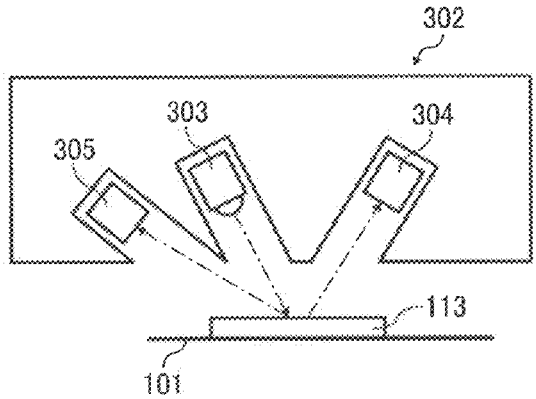
FIG. 4B is an explanatory view showing the schematic configuration of an optical sensor constituting an image detection device for other colors (color)

FIG. 4A is an explanatory view showing the schematic configuration of the optical sensor 301 for black constituting the image detection unit 110. FIG. 4B is an explanatory view showing the schematic configuration of the optical sensor 302 for other colors (color) constituting the image detection unit 110. The optical sensor 301 is constituted by a light-emitting element 303 and a regular reflected light-receiving element 304 which receives regular reflected light from the density patch 113 or the surface of the intermediate transfer belt 101. The optical sensor 302 is constituted by a light-emitting element 303, a regular reflected light-receiving element 304 which receives regular reflected light from the density patch 113 or the surface of the intermediate transfer belt 101, and a diffusive reflected light-receiving element 305 which receives diffusive reflected light from the density patch 113 or the surface of the intermediate transfer belt 101.

Figure 5:
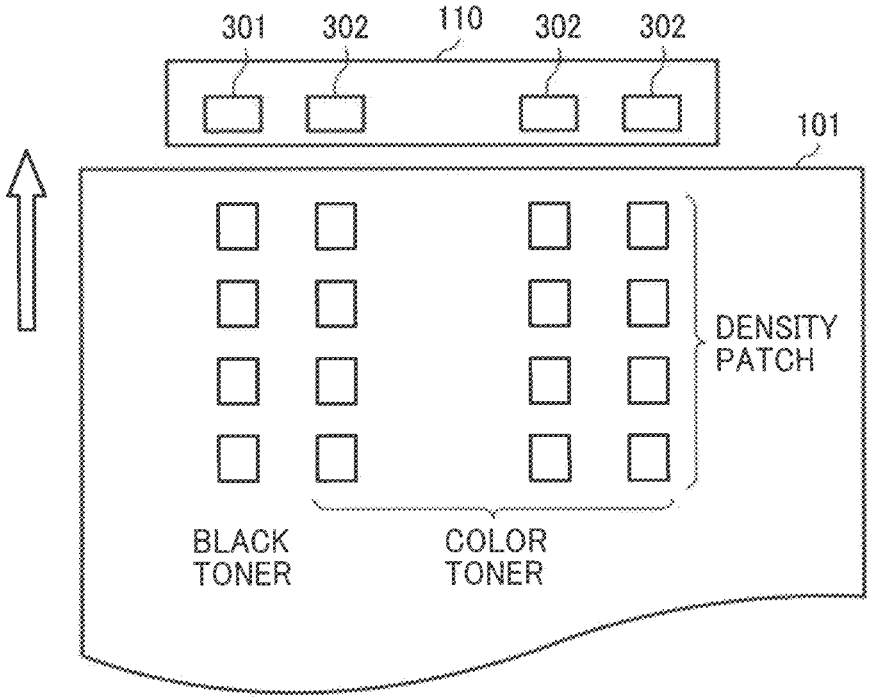
FIG. 5 is an explanatory view showing an arrangement example of optical sensors.

As shown in FIG. 5, the optical sensor 301 and the optical sensors 302 are arranged at positions which can face the density patch 113 formed on the intermediate transfer belt 101. The control unit 41 detects an output voltage from the regular reflected light-receiving element 304 or the diffusive reflected light-receiving element 305 at the timing at which the density patch 113 reaches the positions facing the optical sensor 301 and the optical sensors 302 after write light L starts to be written, and performs adhesion amount conversion processing on the detection result (sensor detection result) to acquire the toner adhesion amount of each density patch 113. Specifically, for example, a conversion table in which the correspondence relationship between the output voltage and the toner adhesion amount is described is stored in a ROM 44 in advance, and the toner adhesion amount is acquired by means of the conversion table. Alternatively, for example, the toner adhesion amount may be acquired by a conversion equation which converts the output voltage to the toner adhesion amount.

Figure 6:
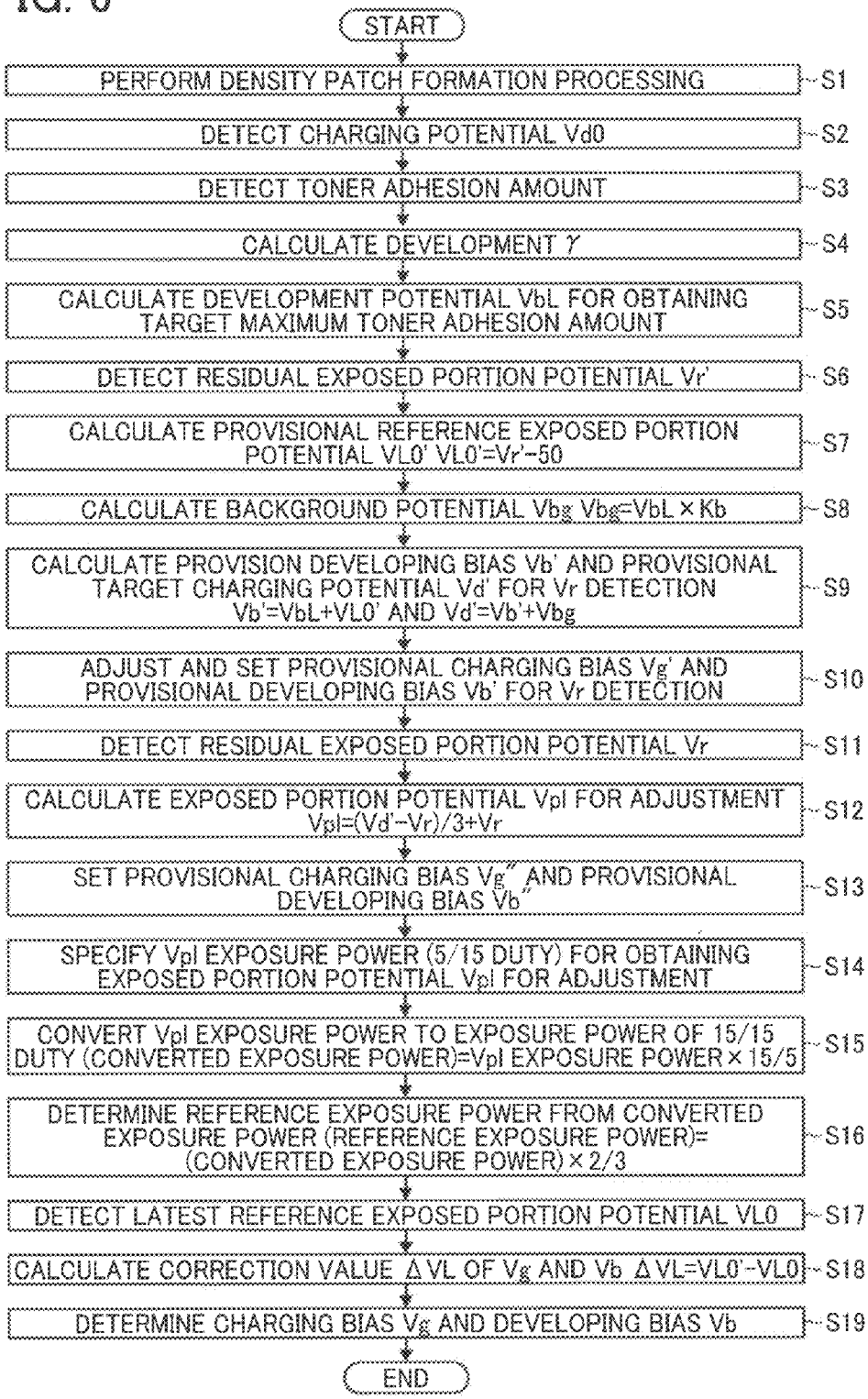
FIG. 6 is a flowchart showing a flow of main processing of process control in the embodiment.

FIG. 6 is a flowchart showing a flow of main processing of the process control in this embodiment. In this embodiment, description will be provided as to a case where the target toner adhesion amount of a toner gradation pattern when the process control is performed such that the adhesion amount conversion processing can be appropriately performed on images having low through high densities formed on the recording medium 112 is in a range of about 0 [mg/cm$^2$] to 0.5 [mg/cm$^2$].

(S1 to S4)

In the Process Control, after a pre-processing step, such as calibration of the image detection unit 110 or abnormality detection, ends, first, density pattern having 10 gradations is formed on the surface of the photosensitive element under image forming conditions (image forming conditions set in the previous process control) of the charging bias Vg0, the developing bias Vb0, the exposure power LDP, and the like currently set (S1). The charging potential (unexposed portion potential) Vd0 at this time is detected by the potential sensor 210 (S2). The toner adhesion amount adhered to the density patch having 10 gradations is detected by the image detection unit 110 (S3). Development γ at the current time is calculated from the charging potential Vd0 detected in S2 and the toner adhesion amount for 10 gradations detected in S3 (S4).

Figure 7:
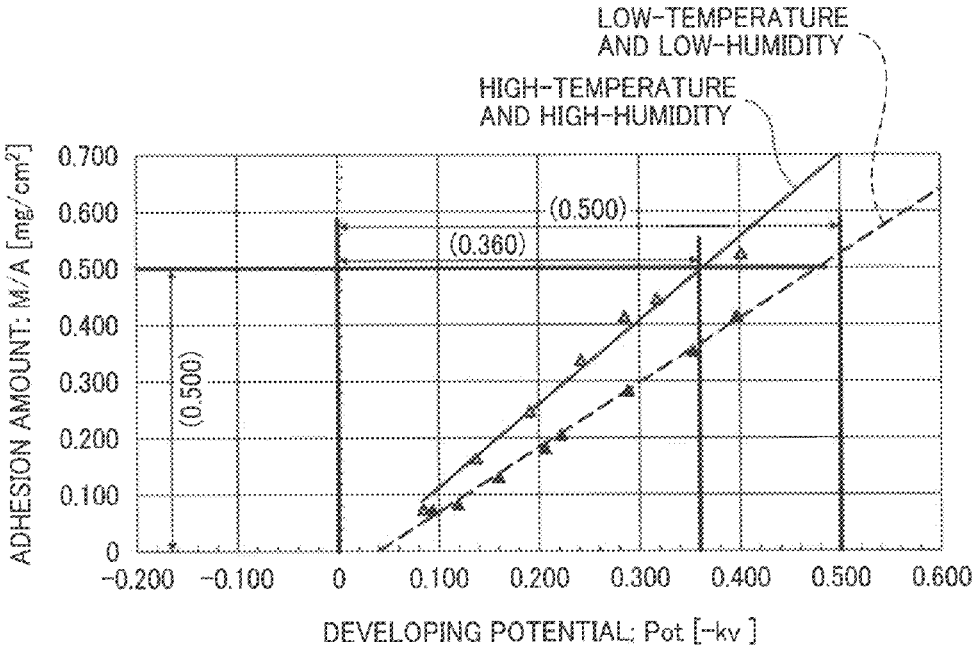
FIG. 7 is a graph showing the measurement result of a toner adhesion amount for a developing potential when a toner gradation pattern is formed in a high-temperature and high-humidity environment and a low-temperature and low-humidity environment.

FIG. 7 is a graph showing the measurement result of a toner adhesion amount for a developing potential when a toner gradation pattern is formed in a high-temperature and high-humidity environment (32 [° C.] and 54 [%]) and a low-temperature and low-humidity environment (10 [° C.] and 15 [%]). In the graph, the horizontal axis represents a developing potential and the vertical axis represents a toner adhesion amount. The development γ is a parameter which represents the slope of the graph and a parameter which represents the correspondence relationship between the developing potential and the toner adhesion amount. The developing potential represents the potential difference between the exposed portion potential VL of the photosensitive element and the developing bias Vb. If the developing potential is high, the toner amount adhered to the one-dot electrostatic latent image increases and image density increases. A background potential described below represents the potential difference between the unexposed portion potential on the photosensitive element, that is, the charging potential Vd and the developing bias Vb. If the background potential is excessively low, toner adheres to the unexposed portion, causing background fouling. If the background potential is excessively high, the magnetic carriers in developer adhere to the surface of the photosensitive element, causing carrier adhesion.

In the high-temperature and high-humidity environment, in order to form a density patch having 0.5 [mg/cm$^2$] which is the maximum toner adhesion amount (target maximum toner adhesion amount) in the target toner adhesion amount range of this embodiment, as shown in FIG. 7, 360 [V] should be applied as the developing potential. Meanwhile, in the low-temperature and low-humidity environment, in order to form a density patch of 0.5 [mg/cm$^2$], the developing potential of 500 [V] should be applied. The developing potential which should be applied so as to form a density path with the same toner adhesion amount of 0.5 [mg/cm$^2$] differs depending on the temperature and humidity environment. The reason why the developing potential differs depending on the temperature and humidity environment is that the toner charge amount is changed depending on the temperature and humidity environment. In general, the toner charge amount decreases in the high-temperature and high-humidity environment, such that the toner adhesion amount increases even when the same developing potential is applied. To the contrary, the toner charge amount increases, such that the toner adhesion amount decreases.

As described above, the developing potential for obtaining target image density (target toner adhesion amount) changes depending on the change in the temperature and humidity environment. The developing potential for obtaining the target toner adhesion amount changes depending on factors other than the temperature and humidity environment. Thus, it is necessary to confirm the development γ at the current time at an appropriate timing and to obtain the developing potential for obtaining the target toner adhesion amount from the development γ to determine various image forming conditions (charging bias Vg, developing bias Vb, reference exposure amount (reference exposure power, reference exposure duty)).

(S5)

In this embodiment, a developing potential VbL for obtaining the toner adhesion amount of 0.5 [mg/cm$^2$] which is the target maximum toner adhesion amount is calculated from the development γ calculated in S4 (S5). Various image forming conditions are adjusted such that the developing potential at the time image formation for obtaining the target maximum toner adhesion amount becomes the developing potential VbL calculated in S5. Hereinafter, the adjustment method will be specifically described.

(S6)

In this embodiment, in a state where the charging bias Vg0 and the developing bias Vb0 currently set are applied, the surface of the photosensitive element is exposed with exposure power LDP' 1.5 times (150%) greater than basic exposure power LDP0 and an exposure duty having the maximum value (15). The potential of an electrostatic latent image (exposed portion) formed in such a manner is detected by the potential sensor 210 as a residual exposed portion potential Vr' (S6). The residual exposed portion potential Vr' is to obtain the developing bias Vb' and a target charging potential Vd' which are used in detecting the final residual exposed portion potential Vr.

(S7)

Next, in this embodiment, a provisional reference exposed portion potential VL0' is calculated from the residual exposed portion potential Vr' detected in S6 by the following equation (1) (S7). The reference exposed portion potential is an exposed portion potential when exposure is carried out with the reference exposure amount (reference exposure power LDP, reference exposure duty).

$$VL0'=Vr'-50 \quad (1)$$

In general, the reason why the value obtained by adding −50 [V] to the residual exposed portion potential Vr' is set as the reference exposed portion potential VL0' it that the reference exposed portion potential is experimentally recognized as being around the value obtained by adding −50 [V] to the residual exposed portion potential Vr'. An error between the provisional reference exposed portion potential VL0' and the actual reference exposed portion potential VL0 is corrected through correction processing described below.

Next, the developing bias Vb' for Vr detection which is used in detecting the final residual exposed portion potential Vr is first calculated by the following equation (2) from the provisional reference exposed portion potential VL0' obtained in the above-described manner.

$$Vb'=VbL+VL0' \quad (2)$$

Subsequently, the target charging potential Vd' for Vr detection is calculated by the following equation (3) from the developing bias Vb' for Vr detection calculated by the equation (2).

$$Vd'=Vb'+Vbg \quad (3)$$

(S8)

Here, although the background potential Vbg in the equation (3) is a constant value (for example, 200 [V]) in the related art, in this embodiment, the background potential Vbg is a variable value depending on the developing potential VbL for the following reason. Specifically, the background potential Vbg is calculated by the following equation (4) (S8).

$$Vbg=VbL\times Kb \quad (4)$$

In the equation (4), Kb is a parameter which represents an appropriate ratio of the background potential Vbg to the developing potential VbL, and is hereinafter called a background potential determination coefficient. If the background potential determination coefficient Kb is in a range of 0.40 to 0.80, and preferably, in a range of 0.40 to 0.45 from the experiment result, it is possible to satisfactorily suppress the above-described changes in image quality. In this embodiment, it is assumed that the reference value of the background potential determination coefficient Kb is set to 0.4.

(S9)

Next, the developing bias Vb' for Vr detection which is used in detecting the final residual exposed portion potential Vr is calculated by the equation (2) from the provisional reference exposed portion potential VL0' calculated in S7 (S9). The target charging potential Vd' for Vr detection is calculated by the equation (3) by using the developing bias Vb' for Vr detection calculated by the equation (2) and the background potential Vbg calculated in S8 (S9).

(S10)

The Charging Bias Vg' for Vr Detection is Set Such that the charging potential becomes the target charging potential Vd' for Vr detection (S10). Specifically, under the conditions that the charging bias is first set to a predefined fixed value (in this embodiment, −550 [V]) and the developing bias is set to a predefined fixed value (in this embodiment, −350 [V]), the surface of the photosensitive element is charged, and the charging potential at this time is detected by the potential sensor 210. If the detection result is within a target range centering on the target charging potential Vd' calculated in S9 (in this embodiment, Vd'±5 [V]), the fixed value (−550 [V]) used for the measurement is set to the charging bias Vg' for Vr detection.

Meanwhile, when the detection result is out of the target range, the relationship between the charging bias and the charging potential at the current time is linearly approximated by a least square method by using the fixed value (−550 [V]) of the charging bias, the detection result (charging potential), the charging bias (in this embodiment, −700 [V]) which is used at the time of the pre-processing of the process control, and the charging potential detected by the potential sensor 210 at that time, thereby obtaining a schematic relational equation (linear approximate equation). The charging bias for Vr detection corresponding to the target charging potential Vd' for Vr detection is specified from the linear approximate equation. Thereafter, the surface of the photosensitive element is charged again with the specified charging bias for Vr detection, and the charging potential at this time is detected by the potential sensor 210. If the detection result is within the target range, the charging bias for Vr detection specified by using the linear approximate equation is determined as the charging bias Vg' for Vr detection. When the detection result is out of the target range, a linear approximate equation which represents the relationship between the charging bias and the charging potential is obtained by adding the measurement result at this time. The same processing is repeated until the detection result is within the target range.

There are many cases where the range of a charging bias which can be measured is limited by the specification or the like of the charging device 201 to be used. In this embodiment, the settable range of the charging bias is limited to be equal to or higher than −450 [V] and equal to or lower than −900 [V]. Thus, in this embodiment, when the charging bias Vg' for Vr detection determined in the above-described manner exceeds the upper limit value ($Vg_{MAX}$=−900 [V]) of the settable range of the charging bias, the upper limit value $Vg_{MAX}$ is set as the charging bias Vg'. When the charging bias Vg' for Vr detection determined in the above-described manner falls below the lower limit value ($Vg_{MIN}$=−450 [V]) of the settable range of the charging bias, the lower limit value $Vg_{MIN}$ is set as the charging bias Vg'.

The developing bias Vb' for Vr detection is corrected and set in accordance with the charging bias Vg' for Vr detection set in the above-described manner such that the background potential becomes the background potential Vbg calculated in S8 (S10).

Figure 8:
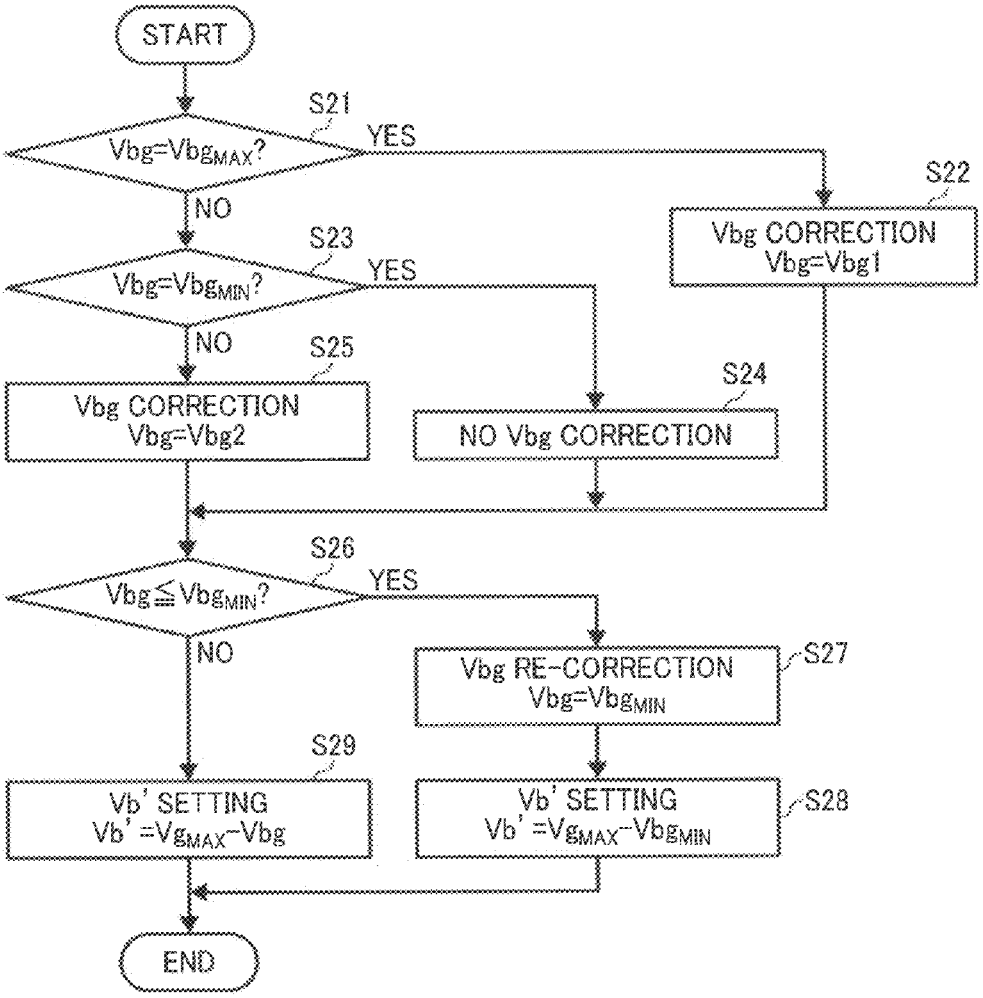
FIG. 8 is a flowchart showing a flow of processing for correcting a developing bias Vb' for Vr detection when a charging bias Vg' is set to a charging bias upper limit value $Vg_{MAX}$.
Figure 9:
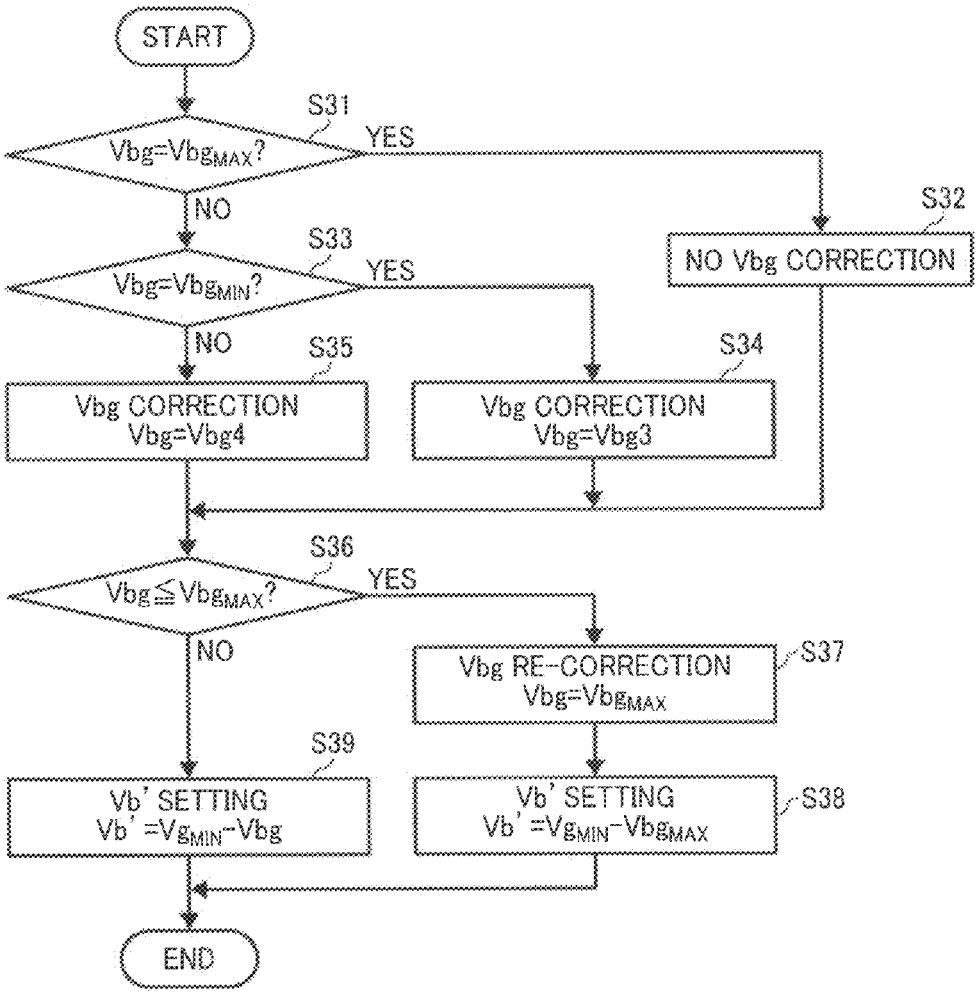
FIG. 9 is a flowchart showing a flow of processing for correcting a developing bias Vb' for Vr detection when a charging bias Vg' is set to a charging bias lower limit value $Vg_{MIN}$.
Figure 10:
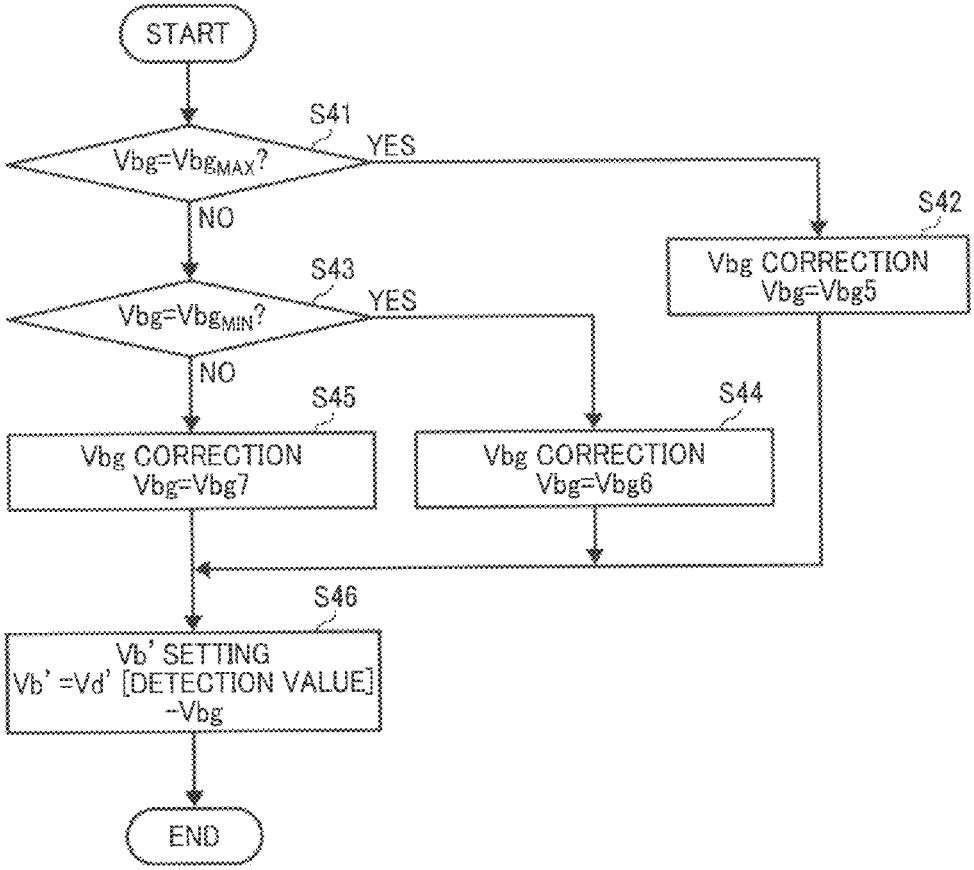
FIG. 10 is a flowchart showing a flow of processing for correcting a developing bias Vb' for Vr detection when a charging bias Vg' is set between a charging bias upper limit value $Vg_{MAX}$ and a charging bias lower limit value $Vg_{MIN}$.

The processing of S10 will be described in detail with reference to FIGS. 8 to 10. FIG. 8 is a flowchart showing a flow of processing for correcting the developing bias Vb' for Vr detection when the charging bias Vg' is set to the charging bias upper limit value $Vg_{MAX}$ (S21 to S29). FIG. 9 is a flowchart showing a flow of processing for correcting the developing bias Vb' for Vr detection when the charging bias Vg' is set to the charging bias lower limit value $Vg_{MIN}$ (S31 to S39). FIG. 10 is a flowchart showing a flow of processing for correcting the developing bias Vb' for Vr detection when the charging bias Vg' is set between the charging bias upper limit value Vg and the charging bias lower limit value $Vg_{MIN}$ (S41 to S46).

(S10: S21 to S29)

When the Charging Bias Vg' is Set to the Charging Bias upper limit value $Vg_{MAX}$, as shown in FIG. 8, if the background potential Vbg is set to the upper limit value $Vbg_{MAX}$ (Yes in S21), the background potential Vbg is corrected to a value which is obtained by the following equation (5) (S22).

$$Vbg=Vbg1=Vbg_{MAX}(Vd'[\text{Calculation Value}]-Vg_{MAX})\times Kc1 \quad (5)$$

In the equation (5), Vd' [Calculation Value] is the target charging potential Vd' for Vr detection calculated in S9 and is distinguished from the charging potential Vd' [Detection Value] detected in S10. In the equation (5), Kc1 is a coefficient for making the ratio of the background potential to the developing potential within the settable range of the charging bias constant and is usually set to the same value as the background potential determination coefficient Kb.

If the background potential Vbg is set to the lower limit value $Vbg_{MIN}$ (Yes in S23), the background potential Vbg is not corrected and is set as the lower limit value $Vbg_{MIN}$ as it is (S24).

If the background potential Vbg is set between the upper limit value $Vbg_{MAX}$ and the lower limit value $Vbg_{MIN}$ (No in S23), the background potential Vbg is corrected to a value obtained by the following equation (6) (S25).

$$Vbg=Vbg2=Vbg-(Vd'[\text{Calculation Value}]-Vg_{MAX})\times Kc1 \quad (6)$$

Subsequently, when the background potential Vbg is equal to or lower than the lower limit value $Vbg_{MIN}$ (Yes in S26), the background potential Vbg is corrected to the lower limit value $Vbg_{MIN}$ (S27), and the developing bias Vb' for Vr detection is set to a value obtained by the following equation (7) (S28).

$$Vb'=Vg_{MAX}-Vbg_{MIN} \quad (7)$$

When the background potential Vbg is between the upper limit value $Vbg_{MAX}$ and the lower limit value $Vbg_{MIN}$ (No in S26), and the developing bias Vb' for Vr detection is set to a value obtained by the following equation (8) (S29).

$$Vb'=Vg_{MAX}-Vbg \quad (8)$$

(S10: S31 to S39)

When the charging bias Vg' is set to the charging bias lower limit value $Vg_{MIN}$, as shown in FIG. 9, if the background potential Vbg is set to the upper limit value $Vbg_{MAX}$ (Yes in S31), the background potential Vbg is not corrected (S32) and is set as the upper limit value Vbg as it is.

If the background potential Vbg is set to the lower limit value $Vbg_{MIN}$ (Yes in S33), the background potential Vbg is corrected to a value obtained by the following equation (9) (S34).

$$Vbg=Vbg3=Vbg_{MIN}-(Vd'[\text{Calculation Value}]-Vg_{MIN})\times Kc2 \quad (9)$$

In the equation (9), similarly to Kc1 which is used in the equations (5) and (6), Kc2 is a coefficient for making the ratio of the background potential to the developing potential within the settable range of the charging bias, and is usually set to the same value as the background potential determination coefficient Kb.

If the background potential Vbg is set between the upper limit value $Vbg_{MAX}$ and the lower limit value $Vbg_{MIN}$ (No in S33), the background potential Vbg is corrected to a value obtained by the following equation (10) (S35).

$$Vbg=Vbg4=Vbg-(Vd'[\text{Calculation Value}]-Vg_{MIN})\times Kc2 \quad (10)$$

Subsequently, when the background potential Vbg is equal to or higher than the upper limit value $Vbg_{MAX}$ (Yes in S36), the background potential Vbg is corrected again to the upper limit value $Vbg_{MAX}$ (S37), and the developing bias Vb' for Vr detection is set to a value obtained by the following equation (11) (S38).

$$Vb'=Vg_{MIN}-Vbg_{MAX} \quad (11)$$

When the background potential Vbg is between the upper limit value $Vbg_{MAX}$ and the lower limit value $Vbg_{MIN}$ (No in S36), the developing bias Vb' for Vr detection is set to a value obtained by the following equation (12) (S39).

$$Vb'=Vg_{MIN}-Vbg \quad (12)$$

(S10: S41 to S46)

When the charging bias Vg' is set between the upper limit value $Vg_{MAX}$ and the lower limit value $Vg_{MIN}$ of the charging bias, as shown in FIG. 10, if the background potential Vbg is set to the upper limit value $Vbg_{MAX}$ (Yes in S41), the background potential Vbg is corrected to a value obtained by the following equation (13) (S42).

$$Vbg=Vbg5=Vbg_{MAX}-(Vd'[\text{Calculation Value}]-Vd'[\text{Detection Value}]) \quad (13)$$

If the background potential Vbg is set to the lower limit value $Vbg_{MIN}$ (Yes in S43), the background potential Vbg is corrected to a value obtained by the following equation (14) (S44).

$$Vbg=Vbg6=Vbg_{MIN}-(Vd'[\text{Calculation Value}]-Vd'[\text{Detection Value}]) \quad (14)$$

When the background potential Vbg is set between the upper limit value Vbg and the lower limit value $Vbg_{MIN}$ (No in S43), the background potential Vbg is corrected to a value obtained by the following equation (15) (S45).

$$Vbg=Vbg7=Vbg-(Vd'[\text{Calculation Value}]-Vd'[\text{Detection Value}]) \quad (15)$$

Thereafter, the developing bias Vb' for Vr detection is set to a value obtained by the following equation (16) (S46).

$$Vb'=Vd'[\text{Detection Value}]-Vbg \quad (16)$$

(S11) Next, the surface of the photosensitive element is exposed by using the provisional charging bias Vg' and the developing bias Vb' for Vr detection set in S10 in the same manner as S6 described above, specifically, specifically, with exposure power LDP' 1.5 times (150%) greater than basic exposure power LDP0 and an exposure duty having the maximum value (15). The potential of an electrostatic latent image (exposed portion) formed in such a manner is the detected potential sensor 210 as the final residual exposed portion potential (detected residual potential) Vr (S11).

(S12)

Figure 11A:
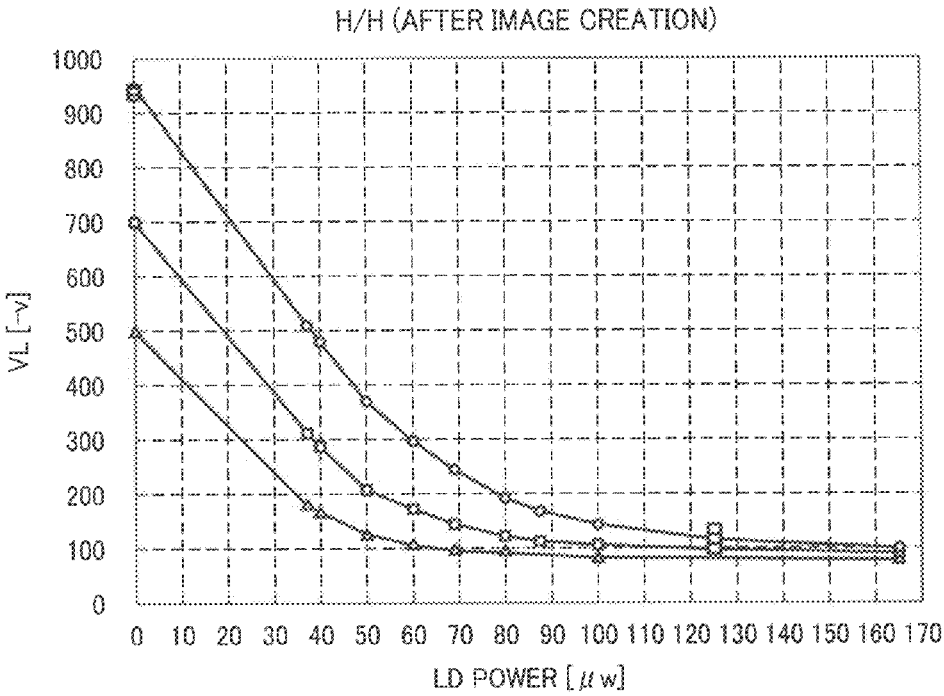
FIG. 11A is a graph showing a relationship between exposure power of a laser diode (LD) and each exposed portion potential VL after a predetermined number of times of image creation in a high-temperature and high-humidity environment.
Figure 11B:
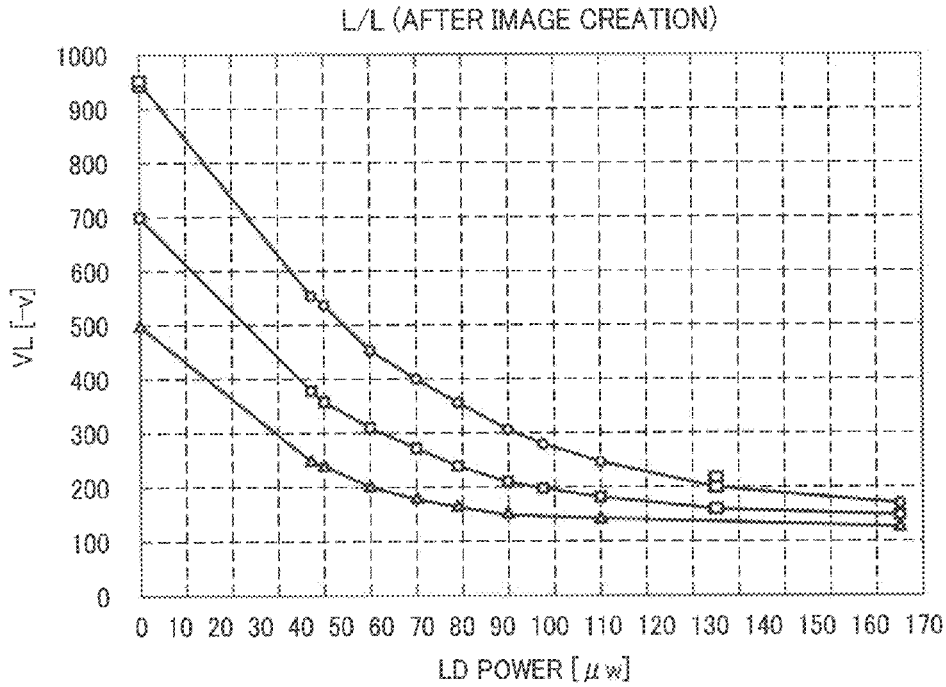
FIG. 11B is a graph showing a relationship between exposure power of an LD and each exposed portion potential VL after the same number of times of image creation in a low-temperature and low-humidity environment.

Thereafter, in this Embodiment, an Exposed Portion potential Vpl for adjustment which belongs to a low exposure amount region where the change ratio of the exposed portion potential on the surface of the photosensitive element to a change in the exposure amount, for example, in each graph shown in FIGS. 11A and 11B, a region roughly from the graph center to the left is calculated by the following equation (17) from the target charging potential Vd' and the residual exposed portion potential Vr (S12).

$$Vpl=(Vd'-Vr)/3+Vr \quad (17)$$

(S13)

The same processing as the processing in S7 to S10 is performed by using a newly detected residual exposed portion potential Vr to reset the provisional charging bias Vg" and the developing bias Vb" (S13).

(S14)

Next, Vpl Exposure Power (Pre Reference Exposure amount) for obtaining the exposed portion potential Vpl for adjustment is specified (S14). In this embodiment, the exposed portion potential Vpl for adjustment is roughly around a value corresponding to ⅓ of the reference exposed portion potential. For this reason, in order to find the optimum Vpl exposure power around the value, with regard to an exposure duty at this time, a 5/15 exposure duty which is ⅓ of the reference exposure amount (exposure duty=15/15) is used.

In a state where the Vpl exposure power for obtaining the exposed portion potential Vpl for adjustment is specified or the exposure duty is fixed to 5/15, electrostatic latent images (exposed portion) are created while sequentially switching exposure power to 60%, 80%, 100%, 120%, and 150% of basic exposure power LDP0. The charging bias and the developing bias at this time are the provisional charging bias Vg" and the developing bias Vb" set in S13. The potential of each exposed portion is detected by the potential sensor 210, and the charging potential Vd at this time is also detected by the potential sensor 210. Five sets of data which represent the correspondence relationship between exposure power corresponding to each exposed portion and the exposed portion potential Vpl for adjustment obtained by the equation (17) from the charging potential Vd and the residual exposed portion potential Vr at this time are calculated. The relationship between exposure power and the exposed portion potential Vpl for adjustment is linearly approximated by a least square method from each data set to obtain a schematic relational equation (linear approximate equation), and the Vpl exposure power for obtaining the exposed portion potential Vpl for adjustment calculated in S12 is specified from the linear approximate equation.

Thereafter, the surface of the photosensitive element is exposed by using the specified Vpl exposure power (exposure duty=5/15), and the exposed portion potential at this time is detected by the potential sensor 210. If the detection result is within the target range (within ±3 [V] of the exposed portion potential Vpl for adjustment calculated in S12), the specified Vpl exposure power is used as it is. When the detection result is out of the target range, processing in which the specified Vpl exposure power is adjusted by a predetermined adjustment value, the surface of the photosensitive element is exposed again by using the adjusted Vpl exposure power, and the exposed portion potential at this time is detected by the potential sensor 210 is repeatedly performed until the detection result is within the target range.

(S15)

In this Way, after the Vpl Exposure Power for obtaining the exposed portion potential Vpl for adjustment is specified, next, the Vpl exposure power is converted to exposure power of the 15/5 exposure duty which is the exposure duty of the reference exposure amount (S15). In this embodiment, the exposure duty which is used to specify the Vpl exposure power is ⅓ of the exposure duty (15/15) of the reference exposure amount, thus the Vpl exposure power specified in S14 is tripled and converted to the exposure power of the 15/15 exposure duty.

(S16)

Next, the reference exposure power is determined from the converted exposure power converted in the above-described manner (S16). Under the conditions of this embodiment, it is recognized through an experiment or the like in advance that the relationship between the converted exposure power and the reference exposure power becomes about ⅔. Thus, in this embodiment, a value obtained by multiplying the converted exposure power by ⅔ is determined as the reference exposure power. The conversion value (in this embodiment, ⅔) is appropriately set through an experiment or the like.

(S17, S18, S19)

After the Reference Exposure Power is Obtained in the above-described manner, finally, correction processing is performed for correcting an error between the reference exposed portion potential VL0' provisionally determined in S7 and the actual reference exposed portion potential VL0. Specifically, an electrostatic latent image (exposed portion) is first created with the reference exposure amount (the reference exposure power and the 15/15 exposure duty determined in S16), and the potential (reference exposed portion potential VL0) of the exposed portion is detected by the potential sensor 210 (S17). The charging bias and the developing bias at this time are the provisional charging bias Vg" and the developing bias Vb" set in S13. A difference ΔVL between the reference exposed portion potential VL0 detected in such a manner and the reference exposed portion potential VL0' provisionally determined in S7 is calculated (S18). The provisional charging bias Vg" and the developing bias Vb" set in S13 are corrected with the difference ΔVL as a correction value to determine the final charging bias Vg and developing bias Vb (S19).

Thus, the final charging bias Vg becomes the following equation (18), and the final developing bias Vb becomes the following equation (19). Meanwhile, when the charging bias Vg and the developing bias Vb after correction exceed the upper/lower limit value set in advance, the charging bias Vg and the developing bias Vb before correction are used as the final values.

$$Vg==Vg''-\Delta VL \tag{18}$$

$$Vb=Vb''-\Delta VL \tag{19}$$

In this embodiment, the degree of toner deterioration in developer on the intermediate transfer belt 101 is detected, and the ratio of the background potential to the developing potential is controlled on the basis of the detected degree of toner deterioration in the process control unit. That is, the background potential determination coefficient is controlled on the basis of the degree of toner deterioration.

<Control of Background Potential Determination Coefficient>

Figure 13:
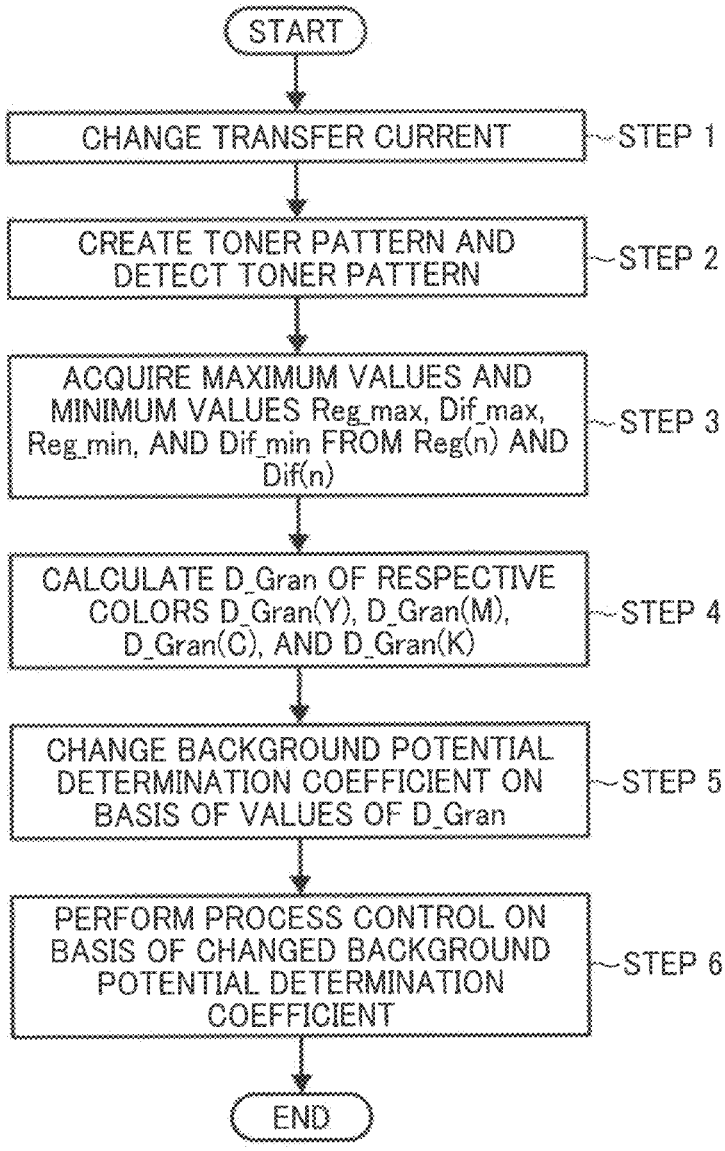
FIG. 13 is a flowchart showing processing for detecting the degrees of deterioration of black toner and color toner to control a background potential determination coefficient in process control.

Next, control in which the degree of toner deterioration of black toner in black developer at the time of monochrome image formation or the degree of toner deterioration of color toner in color developer at the time of full-color image formation to determine the background potential determination coefficient will be described with reference to a flowchart of FIG. 13. In this embodiment, the degree of toner deterioration in each of the toner patterns which are transferred from the photosensitive elements 202Y, 202M, 202C, and 202K to the intermediate transfer belt 101 by the primary transfer units 106Y, 106M, 106C, and 106K is detected by using the image detection unit 110.

Here, the following expression which quantifies the degree of toner deterioration from the detected value has found by the inventors through repetitive experiments focusing that, as toner is deteriorated, toner is not transferred to the intermediate transfer element, and if the adhesion amount to the toner pattern for detection formed on the intermediate transfer element is detected, the variation in the value increases. As deterioration of toner progresses, the variation in the value of the adhesion amount to the toner pattern for detection formed on the intermediate transfer element increases. This is considered because, if developer is deteriorated due to repetitive stress from the developer regulating member, the charged amount of developer also changes. It is also considered because, as deterioration of toner progresses, the amount of toner with changes in the charge amount in developer increases, and the variation in the value of the adhesion amount to the toner pattern for detection increases.

(Step 1)

First, if there is a command to detect the degree of toner deterioration from the control unit 41, a primary transfer current of the primary transfer units 106Y, 106M, 106C, and 106K is changed from a currently set value to a transfer current value for detecting the degree of toner deterioration. The transfer current value for detecting the degree of toner deterioration differs depending on used toner, developer, and a developing device. The image creation conditions other than the transfer condition are determined through the above-described process control.

As described above, there are the following two reasons for changing the transfer current to the transfer current value for detecting the degree of toner deterioration. First, if the transfer current decreases, transfer efficiency of toner on the photosensitive element 202 to the intermediate transfer belt 101 is lowered. Thus, a transfer margin is also lowered, such that deteriorated toner whose charge amount is unstable is not easily transferred to the intermediate transfer belt 101, and the toner pattern is likely to be unstable. For this reason, if the transfer current decreases, the acquired value when the toner pattern is detected by the image detection unit 110 easily varies, thus it is possible to increase sensitivity for detecting the degree of toner deterioration.

Figure 12:
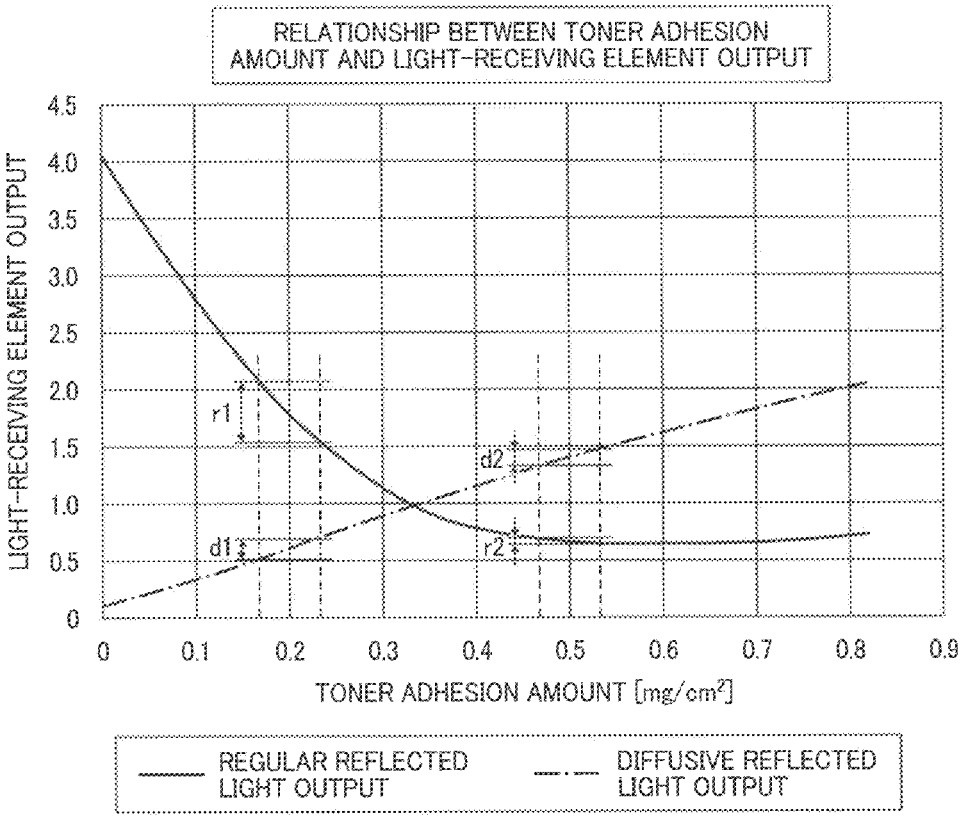
FIG. 12 is a graph showing a relationship between a toner adhesion amount and output voltage values of a first light-receiving element and a second light-receiving element.

Second, if the transfer current decreases, the toner amount which is transferred to the intermediate transfer belt is reduced, such that the toner adhesion amount on the intermediate transfer belt 101 becomes small. As shown in FIG. 12, with regard to the characteristic of the regular reflected light output and the diffusive reflected light output when the toner adhesion amount transferred to the intermediate transfer belt is around 0.2 mg/cm2 and around 0.5 mg/cm2, it can be understood that the variation in the regular reflected light output when the toner adhesion amount is small around 0.2 mg/cm2 is larger (r1>r2). It can also be understood that the diffusive reflected light output undergoes the same variation regardless of the toner adhesion amount (d1≅d2). For this reason, the transfer current decreases to lower the adhesion amount of toner on the intermediate transfer belt 101, and the regular reflected light output and the diffusive reflected light output are acquired, making it possible to increase the variation in the regular reflected light output and to increase sensitivity for detecting the degree of toner deterioration.

(Step 2)

Next, toner patterns for detecting the degree of toner deterioration are created on the photosensitive elements 202Y, 202M, 202C, and 202K by the image forming units 102Y, 102M, 102C, and 102K. The size of each created toner pattern for detecting the degree of toner deterioration is 15 mm in the main scanning direction and 39 mm in the sub scanning direction. In this embodiment, a solid pattern is used as a toner pattern.

The toner patterns formed on the photosensitive elements 202Y, 202M, 202C, and 202K are transferred to the intermediate transfer belt 101 with the primary transfer current value for detecting the degree of toner deterioration set in STEP 1 by the primary transfer units 106Y, 106M, 106C, and 106K. Each toner pattern transferred to the intermediate transfer belt 101 is detected by the image detection unit 110. In detecting the toner pattern, the interval of sampling time is set to 4 msec, and sampling is carried out at equal to or more than 100 points to obtain a five-point moving average value such that there is no affect of reflection irregularly of the intermediate transfer belt 101.

The toner adhesion amount detection sensor 301 for black of the image detection unit 110 includes the regular reflected light-receiving element 304 which receives regular reflected light, and the regular reflected light output is obtained from the regular reflected light-receiving element 304. The color toner adhesion amount detection sensors 302Y, 302M, and 302C of the image detection unit 110 each include the regular reflected light-receiving element 304 which receives regular reflected light, and the diffusive reflected light-receiving element 305 which receives diffusive reflected light, and the output from each light-receiving element is obtained. Here, the output from the regular reflected light-receiving element 304 is referred to as Reg(n), and the output from the diffusive reflected light-receiving element 305 is referred to as Dif(n). In carrying out 100-point sampling to obtain the five-point moving average value, the following two data sets are obtained for Y, M, and C.

Regular reflected light output data: Reg(1), Reg(2), . . . , Reg(20)

Diffusive reflected light output data: Dif(1), Dif(2), . . . , Dif(20)

(STEP 3)

The maximum values and the minimum values constituted by regular reflected light output data and diffusive reflected light output data are selected and recorded in a RAM 43. The maximum value and the minimum values are called Reg_max, Dif_max, Reg_min, and Dif_min.

(Step 4)

If Reg_max, Dif_ax, Reg_min, and Dif_min can be acquired, the degree D_Gran of grainy effect is calculated as the degree of toner deterioration in developer from the values. A calculation expression is as follows. In the case of Y, M, and C, the following expression is used.

$$D_Gran=\alpha\times(Reg_max-Reg_min)+\beta\times(Dif_max-Dif_min)$$

Here, α and β are deteriorated toner determination coefficients specific to an image forming apparatus obtained in advance, and the relationship α>β is established.

In the case of K, the following expression is used.

$$D_Gran=\alpha\times(Reg_max-Reg_min)$$

Here, α and β are values which are experimentally obtained.

Basically, the relationship α≅1 is established, and if the slope of a linear approximate equation representing the relationship between the adhesion amount and the diffusive reflected light output is slope(dif), a calculation expression of β becomes β=1/slope(dif).

The linear approximate equation representing the relationship between the adhesion amount and the diffusive reflected light output in the graph of FIG. 12 for magenta toner is as follows, and the value of β becomes 2.4718.

$$y=2.4718x+0.1104$$

Figure 14:
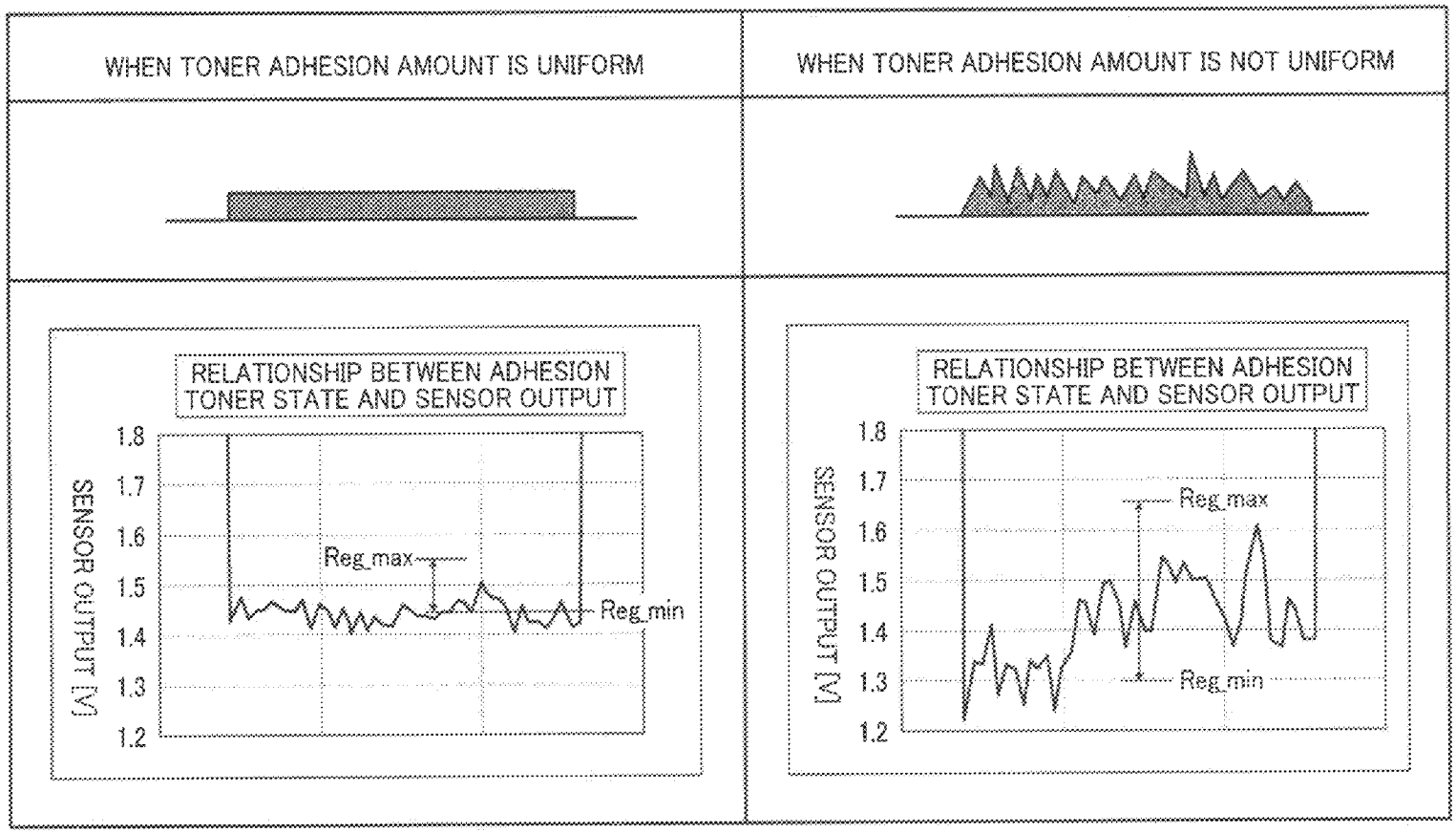
FIG. 14 is an explanatory view showing a relationship between the adhesion state of a toner pattern on an intermediate transfer belt and output data Reg(n) of a toner adhesion amount detection sensor.
Figure 15:
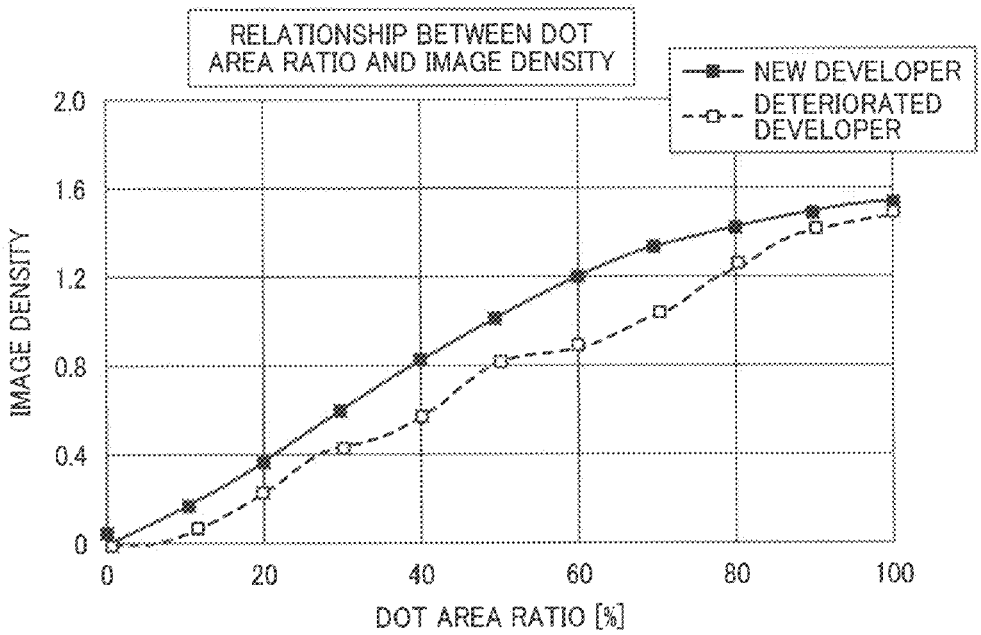
FIG. 15 is a graph showing the state of halftone density in a toner deterioration state.

FIG. 14 is an explanatory view of the relationship between the adhesion state of the toner pattern on the intermediate transfer belt 101 and output data Reg(n) of the black toner adhesion amount detection sensor 301. In the sampling method by the black toner adhesion amount detection sensor 301, when the adhesion state of the toner pattern is uniform, there is no variation in the amount of light received by the regular reflected light-receiving element 304, such that the differences in Reg_max and Reg_min become small. When the adhesion state of the toner pattern is not uniform, there is a variation in the amount of light received by the regular reflected light-receiving element 304, and the differences in Reg_max and Reg_min become small. Here, although a case has been described where only output data Reg(n) is used because the black toner adhesion amount detection sensor 301 is used, the same is applied to reflected light output which is detected by the color toner adhesion amount detection sensors 302Y, 302M, and 302C. That is, the degree D_Gran of grainy effect obtained from Reg_max and Reg_min may be used as the degree of toner deterioration.

The degree of grainy effect of yellow toner calculated in such a manner is referred to as D_Gran(Y), the degree of grainy effect of magenta toner is referred to as D_Gran(M), the degree of grainy effect of cyan toner is referred to as D_Gran(C), and the degree of grainy effect of black toner is referred to as D_Gran(K).

The background potential determination coefficients of the respective colors are determined in accordance with D_Gran (Y), D_Gran(M), D_Gran(C), and D_Gran(K) obtained by the above-described expression.

The STEP 3 and STEP 4 constitute a degree-of-toner-deterioration calculation unit.

(Step 5)

Figure 17:
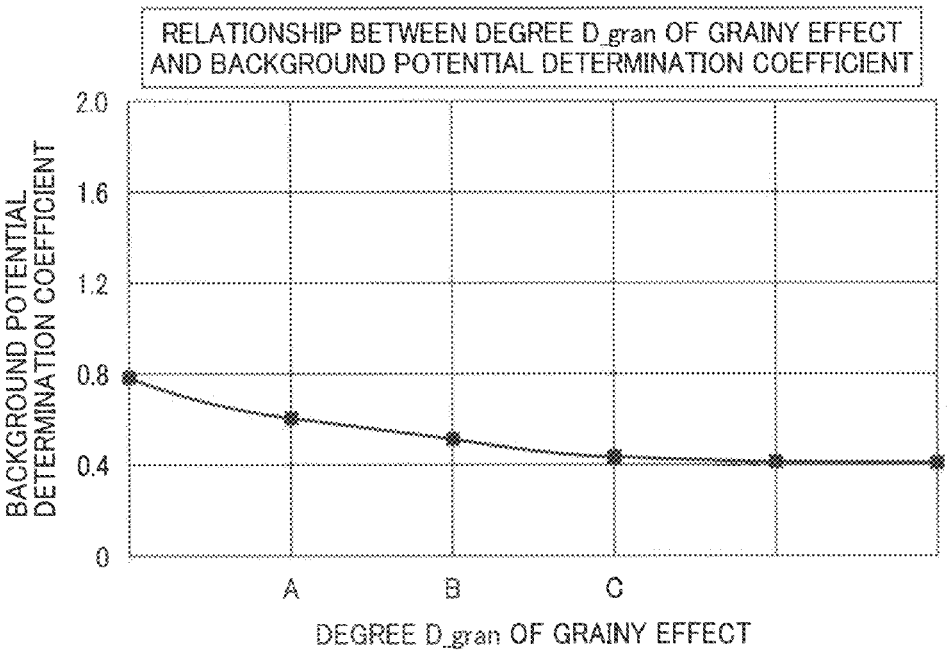
FIG. 17 is a graph showing a relationship between a degree D_Gran of grainy effect and a background potential determination coefficient.

The degree of toner deterioration in developer of each color is determined on the basis of the value of D_Gran. FIG. 17 is a graph showing the relationship between the value of D_Gran and the background potential determination coefficient. The background potential determination coefficient corresponding to the value of D_Gran is determined on the basis of FIG. 17. In FIG. 17, A, B, and C are the degree-of-toner-deterioration determination constants specific to a printer obtained in advance, and the relationship C>B>A is established.

(Step 6)

After the background potential determination coefficient is determined, the above-described process control is performed to obtain appropriate reference exposure power, charging bias Vg, and developing bias Vb.

The STEP 5 and STEP 6 constitute a control unit of the background potential determination coefficient.

As described above, as a preferable sequence, the process control is first performed, the toner adhesion amount of the toner pattern on the intermediate transfer belt 101 is stabilized, and the degree of toner deterioration is detected.

Figure 16:
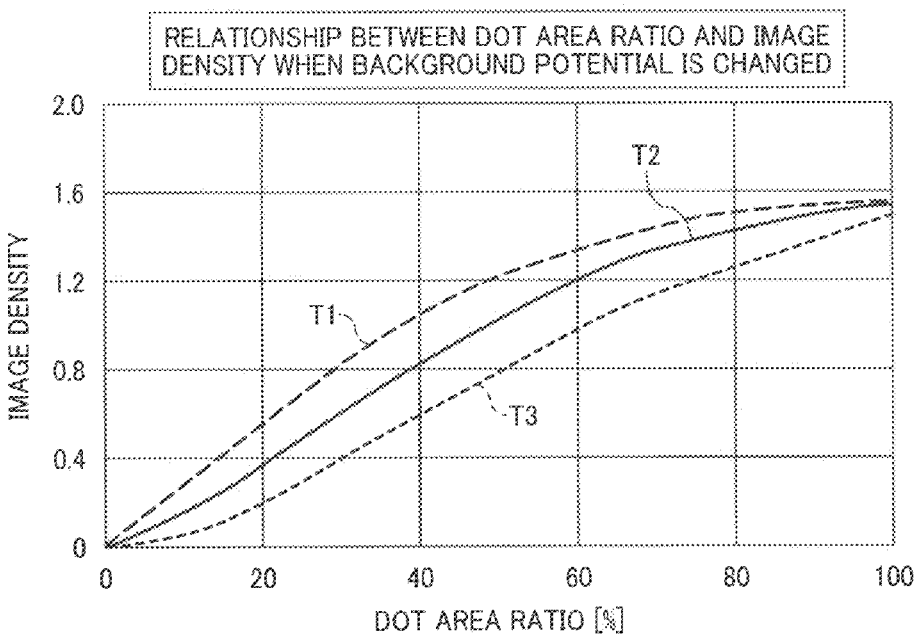
FIG. 16 is a graph showing a relationship between a dot area ratio and image density when a background potential determination coefficient is changed.

The reason why the background potential determination coefficient is changed in accordance with the degree of toner deterioration will be described with reference to FIG. 16. FIG. 16 is a diagram showing the relationship between a dot area ratio and image density. In the drawing, a graph T1 shows a case where the background potential determination coefficient is 0.2, a graph T2 shows a case where the background potential determination coefficient is 0.4, and a graph T3 shows a case where the background potential determination coefficient is 0.6. Of course, if the dot area ratio increases, printing density increases. If the background potential determination coefficient is small, halftone image density increases.

For this reason, satisfactory halftone image density can be obtained over a long period of time by calculating the degree of toner deterioration and changing the background potential coefficient in accordance with the degree of toner deterioration.

Figure 18:
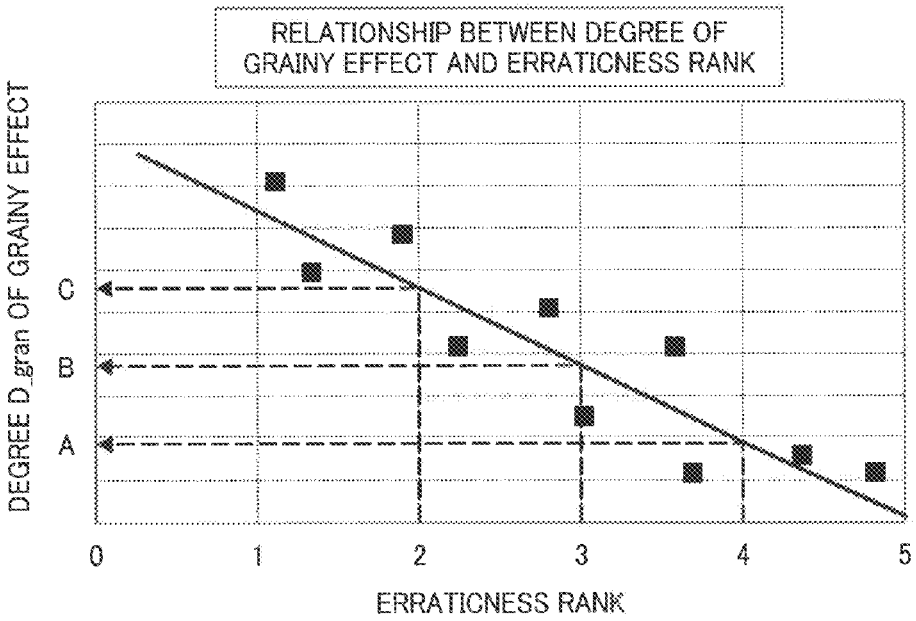
FIG. 18 is an explanatory view showing a relationship between a degree D_Gran of grainy effect and an erraticness rank.

The configuration which is used in the experiment for obtaining A, B, and C according to this embodiment is as follows. An equipment for experiment was Imagio Pro C900, and a sheet type was Type 6200 manufactured by NBS Ricoh. The environmental conditions (temperature/humidity of 10° C./15%, 23° C./50%, and 27° C./80%) or the deterioration states (new product state, stirred state for 10 minutes, and stirred state for 60 minutes) of developer are changed by using the equipment for experiment and the evaluation sheet, and erraticness ranking of D_Gran and a 2 by 2 image was carried out. Erraticness ranking refers to visual evaluation for a stage sample. The result is shown in FIG. 18. At this time, the value of D_Gran when the erraticness rank is rank 4 is referred to as A, the value of D_Gran when the erraticness rank is rank 3 is referred to as B, and the value of D_Gran when the erraticness rank is rank 2 is referred to as C.

Figure 19:
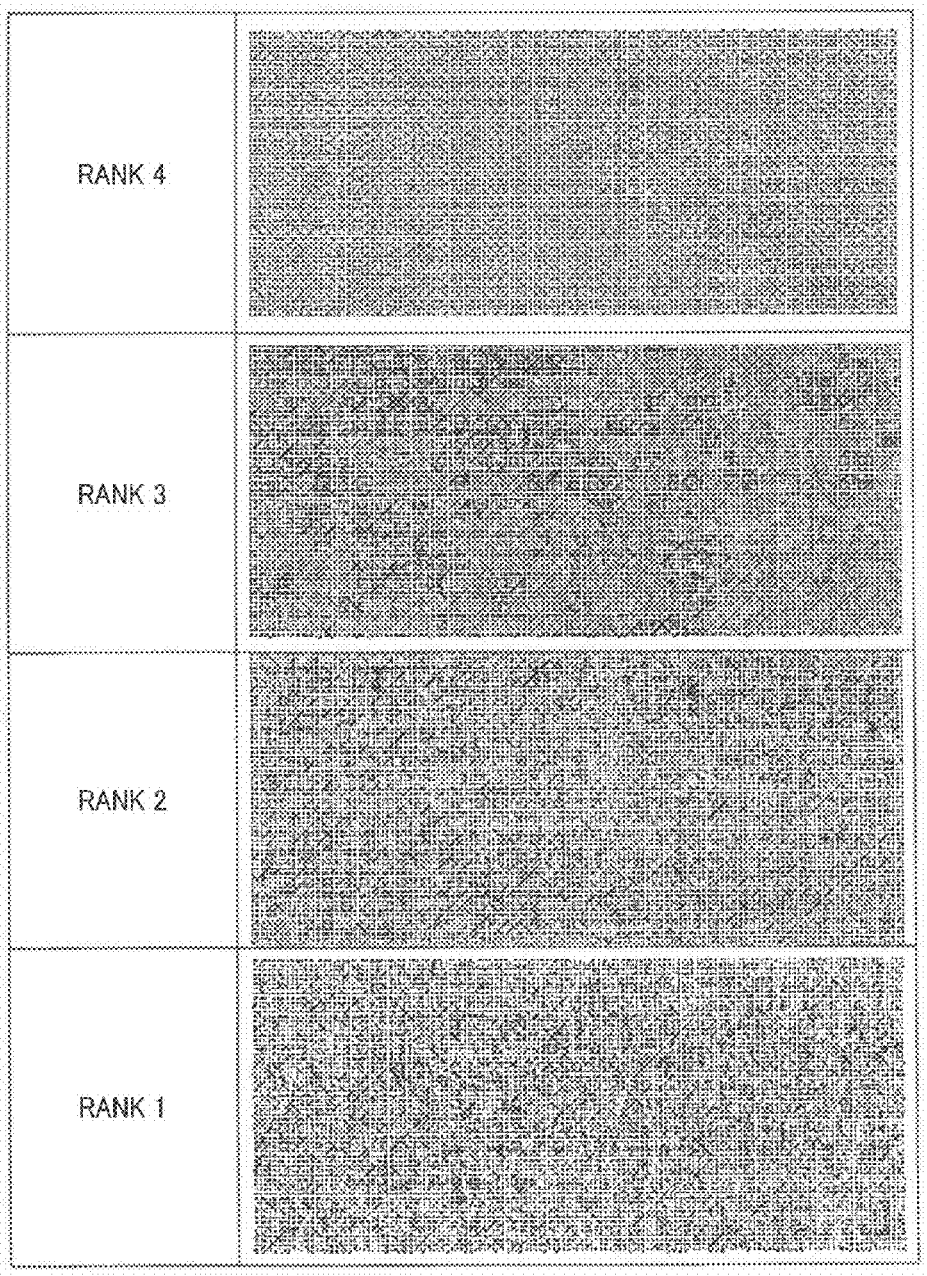
FIG. 19 shows an image example of a stage sample for use in erraticness ranking in this embodiment.

Simple description will be provided as to erraticness ranking of the 2 by 2 image which is currently carried out. The 2 by 2 image is an image in which a dot pattern of a size of two dots in the horizontal and vertical directions is printed in a tiled manner. In this image, a variation can be evaluated rather than evenness of halftone. With regard to an evaluation method, visual determination is made on which level in comparison with a stage sample. FIG. 19 shows an image example of a stage sample which is used in erraticness ranking. In this sample, four or more ranks are determined to be no problem, and three or less ranks are determined to be problematic. With regard to the image example of the stage sample of FIG. 19, a graph for black toner is shown for ease of understanding of the difference between the ranks.

As described above, according to this embodiment, the image forming apparatus includes a toner image forming unit which forms a toner image on the photosensitive element 202 serving as an image carrier, the primary transfer unit 106 which transfers the toner image to the intermediate transfer belt 101 serving as an intermediate transfer element, the secondary transfer unit 111 which transfers the toner image on the intermediate transfer belt 101 to a recording medium, the image detection unit 110 serving as a toner adhesion amount detection unit which detects the toner adhesion amount of the toner image transferred to the intermediate transfer belt 101, a process control unit which controls the toner image forming condition of the toner image forming unit such that the toner image formed on the photosensitive element 202 has a predetermined toner adhesion amount, and a degree-of-toner-deterioration calculation unit which calculates the degree of toner deterioration of the toner adhesion amount detected by the image detection unit 110. A toner pattern for detecting the degree of toner deterioration is created on the photosensitive element 202, the toner pattern is transferred to the intermediate transfer belt 101 under a transfer condition that transfer efficiency is lowered compared to the normal transfer condition of the primary transfer unit 106, and the toner adhesion amount of the toner pattern is detected at multiple places by the toner adhesion amount detection unit. The degree of toner deterioration is calculated by the degree-of-toner-deterioration calculation unit on the basis of a variation in data of the detected toner adhesion amount at the multiple places. Thus, unevenness of data of the toner adhesion amount can be quantitatively obtained and set as a characteristic value representing the degree of toner deterioration. Under the optimum primary condition that there is a large margin at the time of normal image formation, with regard to the variation in data of the toner adhesion amount of the toner pattern on the intermediate transfer belt 101 by deteriorated toner which is not noticeable so much, deteriorated toner included in the toner pattern is made to be not easily primarily transferred compared to the normal state, such that the variation in data of the toner adhesion amount can be more noticeable. Thus, the degree of toner deterioration, that is, the ratio of deteriorated toner in toner can be detected accurately. Process control is performed to control the background potential determination coefficient, which is the ratio of the difference between the potential of the non-electrostatic latent image portion and the developing bias to the developing potential in accordance with the degree of toner deterioration calculated in the above-described manner. With this configuration, control can be performed such that halftone image density which is largely affected by deteriorated toner included in the toner image formed on the intermediate transfer belt 101 becomes uniform image density. Therefore, it is possible to stabilize halftone image density even when deteriorated toner is included in the toner image and to suppress degradation of halftone image density due to deteriorated toner with time, obtaining high-quality images on the recording medium 112.

According to this embodiment, the transfer condition of the primary transfer unit when the toner pattern for detecting the degree of toner deterioration is transferred to the intermediate transfer belt 101 is changed such that the transfer current is lowered by 10 to 50%. With this configuration, it is possible to reliably decrease primary transfer efficiency such that deteriorated toner is not easily transferred, and to accurately detect the ratio of deteriorated toner on the intermediate transfer belt.

According to this embodiment, the black toner adhesion amount detection sensor 301 is an optical sensor which detects the toner adhesion amount on the basis of regular reflected light output data Reg, and if the maximum value and the minimum value among regular reflected light output data at multiple places are Reg_max and Reg_min, the degree-of-toner-deterioration calculation unit uses the degree D_Gran of grainy effect calculated by the following expression as the degree of toner deterioration. With this configuration, it is possible to quantitatively detect the degree of toner deterioration in toner accurately.

$$D_Gran=\alpha\times(Reg_max-Reg_min)$$

Here, $\alpha$ is a deteriorated toner determination coefficient specific to the image forming apparatus obtained in advance.

According to this embodiment, the color toner adhesion amount detection unit is an optical sensor which detects the toner adhesion amount on the basis of regular reflected light output data Reg and diffusive reflected light output data Dif, and if the maximum value and the minimum value from among regular reflected light output data at multiple places are Reg_max and Reg_min, and the maximum value and the minimum value from among diffusive reflected light output data are Dif_max and Dif_min, the degree-of-toner-deterioration calculation unit uses the degree D_Gran of grainy effect calculated by the following expression as the degree of toner deterioration. With this configuration, it is possible to quantitatively the degree of toner deterioration in toner accurately.

$$D_Gran=\alpha\times(Reg_max-Reg_min)+\beta\times(Dif_max-Dif_min)$$

Here, $\alpha$ and $\beta$ are deteriorated toner determination coefficients specific to the image forming apparatus obtained in advance, and the relationship $\alpha>\beta$ is established.

According to this embodiment, the toner adhesion amount detection unit which detects the toner adhesion amount of the toner pattern for deteriorated toner serves as the toner adhesion amount detection unit which is used in the normal process control unit, achieving simplification of the apparatus.

According to the embodiment of the invention, in an intermediate transfer type image forming apparatus in which a toner image formed on a photosensitive element is transferred to a recording medium through an intermediate transfer element, it is possible to suppress degradation of halftone image density due to deteriorated toner with time and to obtain high-quality images on a recording medium.

According to the invention, a toner pattern for detecting the degree of toner deterioration is created on the image carrier, the toner pattern is transferred to the intermediate transfer element under the transfer condition such that transfer efficiency is degraded compared to the normal transfer condition of the primary transfer unit, and the toner adhesion amount of the toner pattern for detecting the degree of toner deterioration is detected at multiple places by the toner adhesion amount detection unit. The degree of toner deterioration is calculated on the basis of the variation in data of the detected toner adhesion amount at multiple places by the degree-of-toner-deterioration calculation unit. Thus, unevenness of data of the toner adhesion amount can be quantitatively obtained and set as a characteristic value representing the degree of toner deterioration. Under the optimum primary transfer condition that there is a large margin at the time of normal image formation, with regard to the variation in data of the toner adhesion amount of the toner pattern on the intermediate transfer element by deteriorated toner which is not noticeable so much, deteriorated toner included in the toner pattern is made to be not easily primarily transferred compared to the normal state, such that the variation in data of the toner adhesion amount can be more noticeable. Process control is performed to control the ratio of the difference between the potential of the non-electrostatic latent image portion and the developing bias to the developing potential in accordance with the degree of toner deterioration calculated in the above-described manner. Therefore, control can be performed such that halftone image density which is largely affected by deteriorated toner included in the toner image formed on the intermediate transfer element becomes predetermined image density.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier;

a toner image forming unit that forms a toner image on the image carrier;

a primary transfer unit that transfers the toner image on the image carrier to an intermediate transfer element;

a secondary transfer unit that transfers the toner image on the intermediate transfer element to a recording medium;

a toner adhesion amount detection unit that detects a toner adhesion amount of the toner image transferred to the intermediate transfer element;

a process control unit that causes the toner image forming unit to form a predetermined toner pattern by a normal image forming operation on a surface of the image carrier at a predetermined timing, causes the primary transfer unit to transfer the predetermined toner pattern on the intermediate transfer element, causes the toner adhesion amount detection unit to detect a toner adhesion amount of the predetermined toner pattern, and adjusts at least one of a charging bias, an exposure amount, and a developing bias on the basis of the detection result so as to obtain a developing potential, which is a difference between a developing bias and a potential of an electrostatic latent image portion, so that a toner adhesion amount of a predetermined electrostatic latent image reaches a target toner adhesion amount; and a degree-of-toner-deterioration calculation unit that calculates a degree of toner deterioration from the toner adhesion amount detected by the toner adhesion amount detection unit, wherein the process control unit further causes the toner image forming unit to form a toner pattern for detecting a degree of toner deterioration on the image carrier, causes the primary transfer unit to transfer the toner pattern from the image carrier to the intermediate transfer element under a transfer condition such that transfer efficiency is lowered compared to a transfer condition at the time of image formation, causes the toner adhesion amount detection unit to detect toner adhesion amount of the toner pattern at multiple places, causes the degree-of-toner-deterioration calculation unit to calculate a degree of toner deterioration on the basis of a variation in data of the toner adhesion amount at the multiple places detected by the toner adhesion amount detection unit, and controls a ratio of the difference between a potential of a non-electrostatic latent image portion and the developing bias to the developing potential depending on the degree of toner deterioration calculated by the degree-of-toner-deterioration calculation unit.

2. The image forming apparatus according to claim 1, wherein the transfer condition of the primary transfer unit in transferring the toner pattern for detecting the degree of toner deterioration, from the image carrier to the intermediate transfer element, is set in a manner such that a transfer current is lowered by 10% to 50% compared to the transfer condition at the time of image formation.

3. The image forming apparatus according to claim 1, wherein the toner adhesion amount detection unit is an optical sensor which detects the toner adhesion amount on the basis of regular reflected light output data Reg reflected by the toner pattern in black toner, and the degree-of-toner-deterioration calculation unit uses a degree D_Gran of grainy effect calculated by the following expression as the degree of toner deterioration, $$D_Gran=\alpha\times(Reg_max-Reg_min),$$

where the Reg_max and the Reg_min are respectively a maximum value and a minimum value among regular reflected light output data at the multiple places, and $\alpha$ is a deteriorated toner determination coefficient specific to the image forming apparatus, which is obtained in advance.

4. The image forming apparatus according to claim 1, wherein the toner adhesion amount detection unit is an optical sensor which detects the toner adhesion amount on the basis of regular reflected light output data Reg and diffusive reflected light output data Dif reflected by the toner pattern in color toner, and the degree-of-toner-deterioration calculation unit uses a degree D_Gran of grainy effect calculated by the following expression as the degree of toner deterioration, $$D_Gran=\alpha\times(Reg_max-Reg_min)+\beta\times(Dif_max-Dif_min)$$

where the Reg_max and the Reg_min are respectively a maximum value and a minimum value among regular reflected light output data at the multiple places, the Dif_max and the Dif_min are respectively a maximum value and a minimum value among diffusive reflected light output data at the multiple places, $\alpha$ and $\beta$ are deteriorated toner determination coefficients specific to the image forming apparatus, which are obtained in advance, and relationship $\alpha>\beta$ is established.

5. An image forming method performed in an image forming apparatus that includes an image carrier, a toner image forming unit, a primary transfer unit, a secondary transfer unit, a toner adhesion amount detection unit, a process control unit, and a degree-of-toner-deterioration calculation unit, the method, which is performed using the process control unit, comprising:

causing the toner image forming unit to form a toner pattern for detecting a degree of toner deterioration on the image carrier;

causing the primary transfer unit to transfer the toner pattern from the image carrier to the intermediate transfer element under a transfer condition such that transfer efficiency is lowered compared to a transfer condition at the time of normal image formation;

causing the toner adhesion amount detection unit to detect toner adhesion amount of the toner pattern at multiple places;

causing the degree-of-toner-deterioration calculation unit to calculate a degree of toner deterioration on the basis of a variation in data of the toner adhesion amount at the multiple places detected by the toner adhesion amount detection unit, and controlling a ratio of the difference between a potential of a non-electrostatic latent image portion and a developing bias to a developing potential depending on the degree of toner deterioration calculated by the degree-of-toner-deterioration calculation unit.

6. The image forming apparatus according to claim 1, wherein the ratio is a value in a range of 0.40 to 0.80.

7. The image forming apparatus according to claim 6, the value is in a range of 0.40 to 0.45.

8. The image forming apparatus according to claim 5, wherein the ratio is a value in a range of 0.40 to 0.80.

9. The image forming apparatus according to claim 8, the value is in a range of 0.40 to 0.45.

* * * * *